US008328442B2

(12) United States Patent
Bandholz et al.

(10) Patent No.: US 8,328,442 B2
(45) Date of Patent: Dec. 11, 2012

(54) PRINTER DRIVE TRAIN FOR PROVIDING AND MAINTAINING RIBBON TENSION

(75) Inventors: Brent A. Bandholz, Hubertus, WI (US); Richard L. Carriere, Oak Creek, WI (US); Robert J. Godfrey, Baraboo, WI (US); Josh Shao Hwa Lee, Singapore (SG)

(73) Assignee: Brady Worldwide, Inc., Milwaukee, WI (US)

( * ) Notice: Subject to any disclaimer, the term of this patent is extended or adjusted under 35 U.S.C. 154(b) by 783 days.

(21) Appl. No.: 12/482,628

(22) Filed: Jun. 11, 2009

(65) Prior Publication Data

US 2009/0317162 A1 Dec. 24, 2009

Related U.S. Application Data

(60) Provisional application No. 61/061,432, filed on Jun. 13, 2008.

(51) Int. Cl.
*B41J 33/00* (2006.01)

(52) U.S. Cl. ..... 400/221; 400/236.2; 400/234; 400/235; 400/236

(58) Field of Classification Search ..... 400/234–236, 400/221, 221.1, 221.2, 218, 236.2, 223
See application file for complete search history.

(56) References Cited

U.S. PATENT DOCUMENTS 4,707,154 A * 11/1987 Arai ..... 400/185
4,869,357 A 9/1989 Batchelder
5,451,996 A * 9/1995 Awai et al. ..... 347/214
5,820,279 A * 10/1998 Lodwig et al. ..... 400/234
5,820,280 A 10/1998 Fox
5,909,791 A 6/1999 DiStefano
5,927,875 A * 7/1999 Lau et al. ..... 400/234
5,938,350 A * 8/1999 Colonel ..... 400/234
5,951,177 A 9/1999 Schanke et al.
6,082,912 A * 7/2000 Shimizu et al. ..... 400/120.01
6,129,463 A * 10/2000 Lau et al. ..... 400/234
6,142,686 A 11/2000 Schanke et al.
6,962,451 B2 * 11/2005 Narita et al. ..... 400/207
7,070,347 B2 7/2006 Carriere et al.

(Continued)

FOREIGN PATENT DOCUMENTS

GB 2436316 9/2007

OTHER PUBLICATIONS

PCT/US2009/047014 Search Report & Written Opinion, Dec. 17, 2009.

*Primary Examiner* — Daniel J Colilla
*Assistant Examiner* — David Banh
(74) *Attorney, Agent, or Firm* — Quarles & Brady LLP

(57) ABSTRACT

A drive train for a printer is disclosed that provides and maintains a desired tension in the ribbon during transfer of the ribbon between a supply spool and a take-up spool. The drive train is configured to pre-tension the ribbon proximate the driven spool prior to driving the drive roller. During operation, the drive train provides and maintains the requisite tension in the ribbon proximate the driven spool with use of a slip-overdrive assembly. Additionally, the drive train induces a drag on the spool from which ribbon is being unwound with the use of a drag-overrun assembly.

17 Claims, 13 Drawing Sheets

U.S. PATENT DOCUMENTS

2002/0041782 A1* 4/2002 Mastinick et al. ..... 400/192
2003/0049065 A1 3/2003 Barrus et al.
2004/0042835 A1* 3/2004 Takahashi et al. ..... 400/235
2004/0071487 A1 4/2004 Ono et al.
2005/0036812 A1* 2/2005 Carriere et al. ..... 400/218
2006/0007296 A1* 1/2006 Bouverie et al. ..... 347/219
2006/0035740 A1* 2/2006 Lehtovaara et al. ..... 474/237
2006/0291092 A1* 12/2006 Tsuneyoshi et al. ..... 360/96.5
2009/0226234 A1* 9/2009 Obenshain ..... 400/218
2010/0247222 A1* 9/2010 Bouverie et al. ..... 400/693.1

* cited by examiner

PRINTER DRIVE TRAIN FOR PROVIDING AND MAINTAINING RIBBON TENSION

CROSS REFERENCES TO RELATED APPLICATIONS

This application claims priority to U.S. provisional application No. 61/061,432 filed Jun. 13, 2008, which is hereby incorporated by reference as if fully set forth herein.

STATEMENT REGARDING FEDERALLY SPONSORED RESEARCH

Not Applicable.

BACKGROUND OF THE INVENTION

The present invention relates to printer drive trains, and more particularly to a printer drive train for providing and maintaining ribbon tension upstream and downstream of a print head.

Many printers incorporate a ribbon used as a carrier or substrate for the print material (e.g., ink) that is transferred to a print media during the printing process. For example, thermal transfer printers include a thermal print head that selectively heats the ribbon to transfer ink onto a print media, such as a label. During a typical printing cycle, the ribbon is unwound from a supply spool, directed downstream between the thermal print head and a drive roller where it comes into contact with and prints to the print media, and is subsequently wound about a take-up spool.

To move the print media and ribbon upstream and downstream of the print head, a drive motor (e.g., a stepper motor) is engaged to a drive train that in turn is coupled via gears to the drive roller, supply spool, and/or take-up spool. This complex series of gears creates several challenges related to providing and maintaining the optimal tension in the ribbon both during and between printing cycles.

Improper tension in the ribbon may cause slack in the ribbon both upstream and downstream of the print head. A ribbon exhibiting excessive slack can degrade print quality and lead to other issues with the operation of the printer. For instance, if the tension of the ribbon drops below an operational threshold, creases or wrinkles may develop in the ribbon resulting in print defects. Moreover, slack ribbon is increasingly susceptible to thermal distortion resulting from the heat of the thermal print head and/or may result in drag on the print media resulting in visible scuff marks formed on the print media.

Another challenge arises between printing cycles in maintaining ribbon tension such that a subsequent printing cycle begins with a properly tensioned ribbon. This issue is exacerbated when the direction the ribbon cartridge is being driven is reversed (i.e., from downstream to upstream and vice versa). Moreover, backlash inherent in the gear train also presents a challenge to ensure that the ribbon is tensioned before the print cycle begins. Without the appropriate tension applied to the ribbon, excess ribbon slack may be introduced causing any of the issues discussed above.

Present designs incorporate tensioning elements within the ribbon cartridge to prevent freewheeling of the supply spool and take-up spool when not being driven by the drive motor. However, internal tensioning elements in the ribbon cartridge are less than ideal because of the added costs each element adds to the ultimately disposable ribbon cartridge.

In light of the above challenges, a need exists for a drive train that provides and maintains proper tensioning of a ribbon. In particular, a need exists for a drive train that provides and maintains sufficient, but not excessive, tension in multiple ribbon feed directions and properly coordinates with the rotation of the drive roller.

SUMMARY OF THE INVENTION

The present invention generally provides a drive train for a printer that provides and maintains a desired tension in the ribbon during transfer of the ribbon between a supply spool and a take-up spool. The drive train is configured to pre-tension the ribbon proximate the driven spool prior to driving the drive roller. During operation, the drive train provides and maintains the requisite tension in the ribbon proximate the driven spool with use of a slip-overdrive assembly. Additionally, the drive train induces a drag on the spool from which ribbon is being unwound with the use of a drag-overrun assembly.

In one aspect, the present invention provides a drive train for a printer that comprises a drive motor for selectively driving a drive roller and a take-up spool to unwind a ribbon from a supply spool and wind the ribbon about the take-up spool. A take-up slip-overdrive assembly is operationally engaged with the drive motor and the take-up spool to maintain a take-up tension in the ribbon downstream of the drive roller by overdriving the take-up spool relative to the drive roller to wind the ribbon about the take-up spool. A supply drag-overrun assembly is operationally engaged with the supply spool to maintain a supply tension in the ribbon upstream of the drive roller by resisting unwinding of the ribbon from the supply spool.

In another aspect, the invention provides a drive train for a printer that comprises a drive motor for driving a drive roller about a drive axis and at least one of a supply spool and a take-up spool to wind and unwind a ribbon about the supply spool and the take-up spool depending upon a direction of rotation of the drive motor. A drive direction assembly is operationally coupled to the drive motor and pivotable about the drive axis between a downstream direction, at which the drive motor drives the take-up spool to unwind the ribbon from the supply spool and wind the ribbon about the take-up spool, and an upstream direction, at which the drive motor drives the supply spool to unwind the ribbon from the take-up spool and wind the ribbon about the supply spool. A take-up slip-overdrive assembly is operationally engaged with the take-up spool and selectively engaged with the drive direction assembly when the drive direction assembly is in the downstream direction. A supply drag-overrun assembly is operationally engaged with the supply spool. The take-up slip-overdrive assembly maintains a take-up tension in the ribbon downstream of the drive roller by overdriving the take-up spool relative to the drive roller to wind the ribbon about the take-up spool, the supply drag-overrun assembly maintains a supply tension in the ribbon upstream of the drive roller by resisting unwinding of the ribbon from the supply spool.

These and still other aspects of the present invention will be apparent from the description that follows. In the detailed description, a preferred example embodiment of the invention will be described with reference to the accompanying drawings. This embodiment does not represent the full scope of the invention; rather the invention may be employed in other embodiments. Reference should therefore be made to the claims herein for interpreting the breadth of the invention.

DETAILED DESCRIPTION OF THE PREFERRED EXAMPLE EMBODIMENT

The preferred example embodiment of the invention will be described in relation to a thermal transfer printer. However, the present invention is equally applicable to other types and styles of printers that may benefit from the incorporation of a drive train that provides and maintains an appropriate tension in the print ribbon and/or print media.

Figure 1:
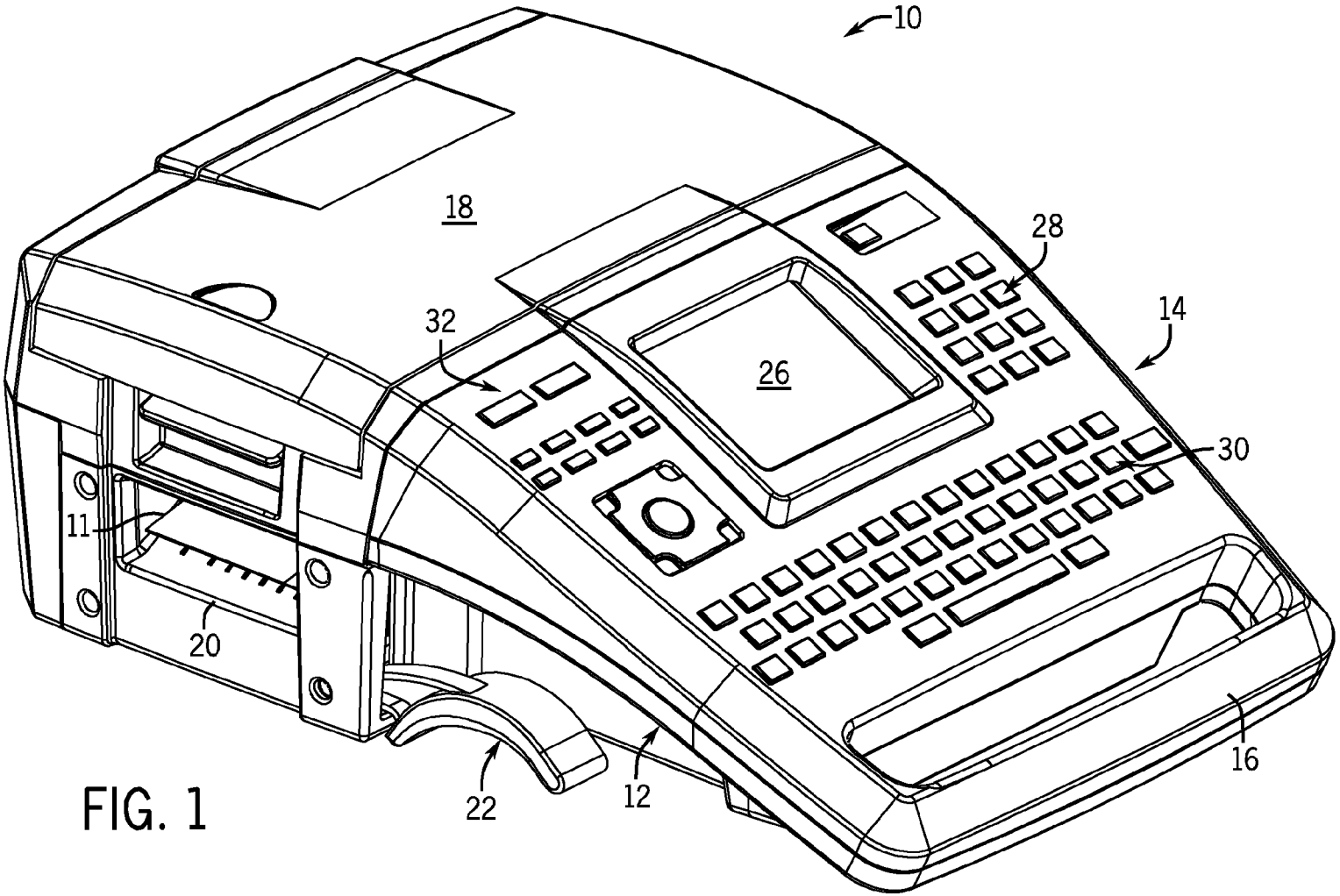
FIG. 1 is an isometric view of a printer incorporating the present invention.

With initial reference to FIG. 1, a printer 10 capable of printing on a print media 11 (e.g., adhesive labels, plain paper, plastic transparencies, and the like) is shown. The printer 10 has a body 12 including a user interface 14 for communication between a user and the printer 10, a handle 16 for easy transport of the printer 10, a moveable cover 18 for accessing a print assembly 34 contained within the body 12, a print slot 20 from which the printed-on print media 11 exits from the printer 10, and a cutting assembly 22 for assisting in the cutting or separation of the print media 11.

The user interface 14 may include, but is not limited to, a display 26 for displaying information, a keypad 28 and a keyboard 30 for entering data, and function buttons 32 that may be configured to perform various typical printing functions (e.g., cancel print job, advance print media, and the like) or be programmable for the execution of macros containing preset printing parameters for a particular type of print media 11. The user interface 14 may be supplemented by or replaced by other forms of data entry or printer control such as a separate data entry and control module linked wirelessly or by a data cable operationally coupled to a computer, a router, or the like. Additionally, the user interface 14 is operationally coupled to a controller (not shown) for controlling the operation of the printer 10.

Figure 2:
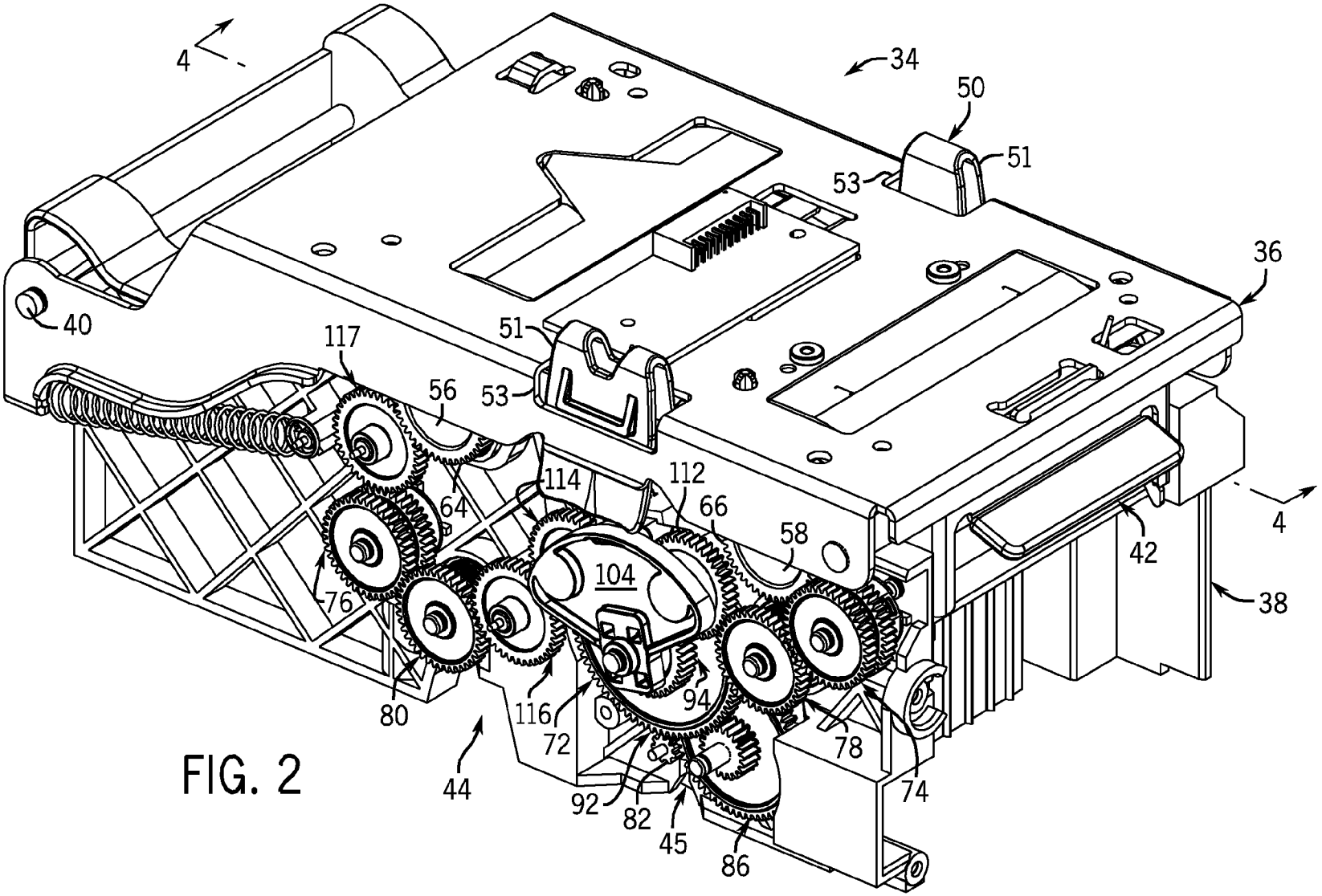
FIG. 2 is an isometric view of a print assembly shown removed from the printer of FIG. 1 with the print assembly in a closed position.

Referring now to FIG. 2, the print assembly 34 is shown after having been removed from the inside of the printer 10. The print assembly 34 includes an upper print frame 36 and a lower print frame 38. On one end, the upper print frame 36 and the lower print frame 38 are pivotally connected at a hinge 40. On the opposite end, a latch 42 releasably secures the upper print frame 36 and the lower print frame 38 together in the closed position. Additionally, a drive train 44 is mounted on the side of the lower print frame 38 for transmitting rotation of a drive motor 45 to a drive roller 47 (shown best in FIG. 4) and a ribbon cartridge 50. In general, the drive motor 45 drives drive train 44 in either an upstream direction (shown in FIG. 7) or a downstream direction (shown in FIG. 6). The construction and operation of the drive train 44 is discussed in greater detail below.

Figure 3:
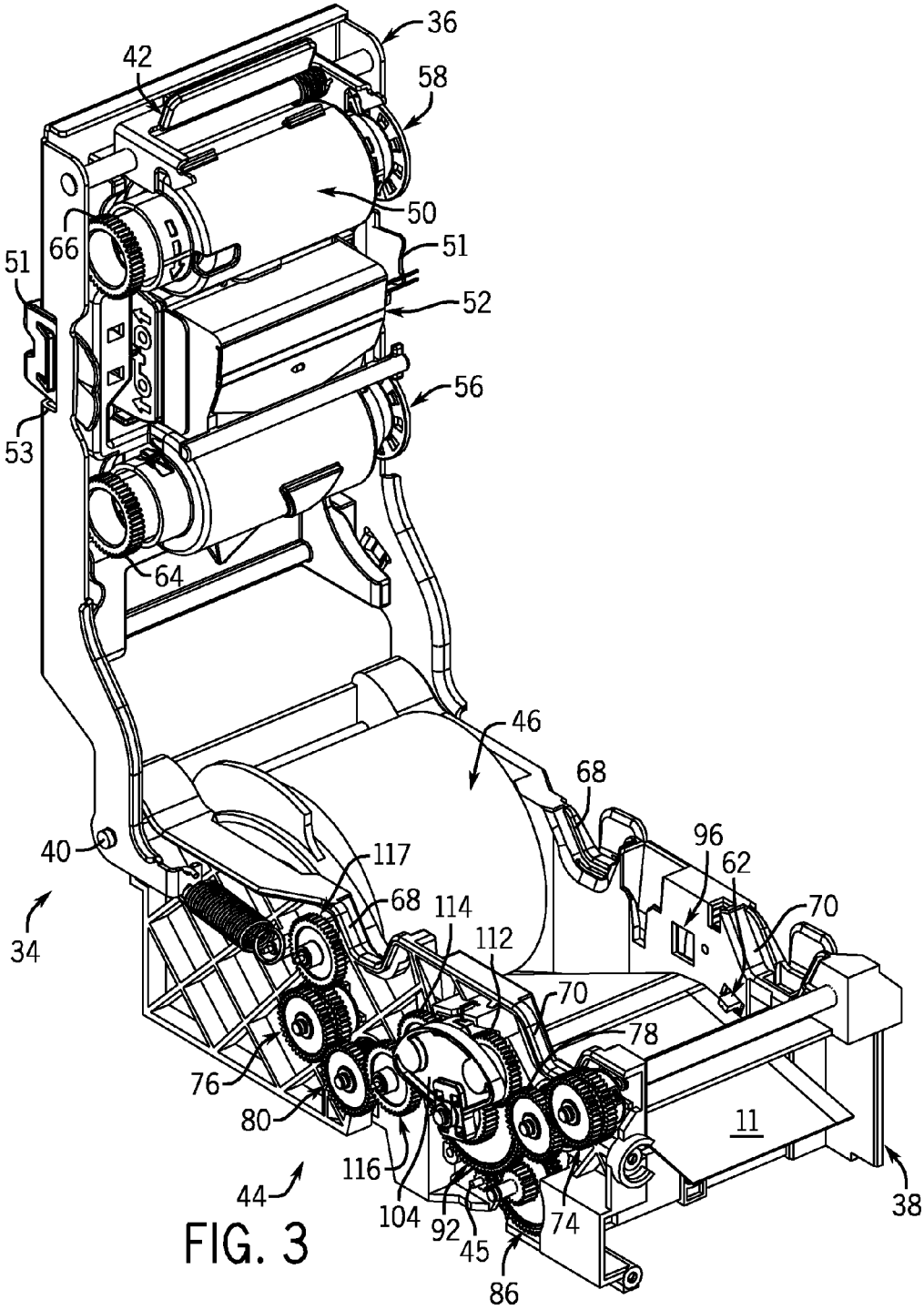
FIG. 3 is an isometric view of the print assembly of FIG. 2 shown with the upper frame in the opened position.
Figure 4:
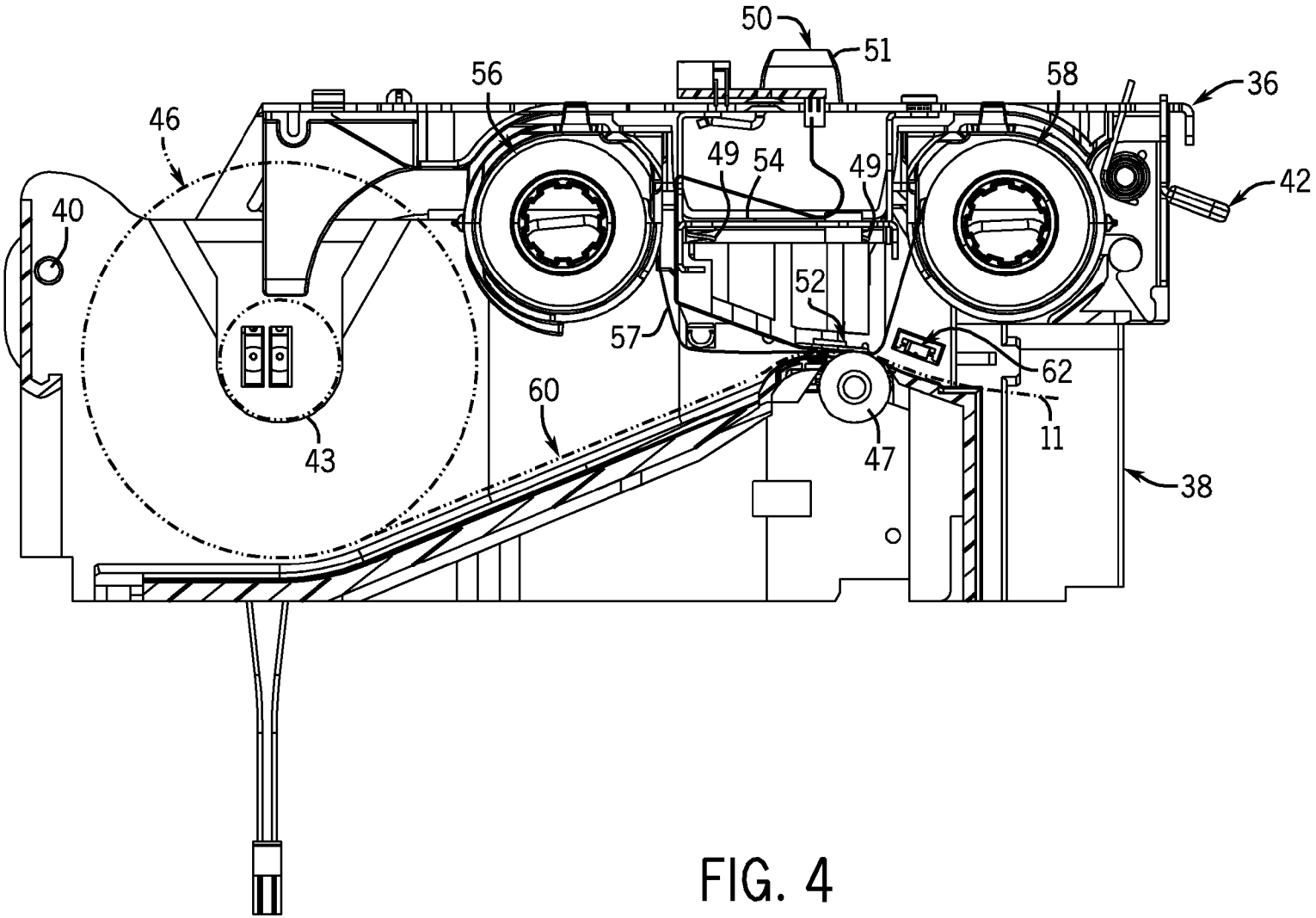
FIG. 4 is a partial section view along line 4-4 of FIG. 2.

With additional reference to FIGS. 3 and 4, the print assembly 34 is shown in FIG. 3 after the latch 42 has been released to allow the upper print frame 36 to pivot away from the lower print frame 38 into the opened position, thus exposing the interior of the print assembly 34. A roll assembly 46 is located within the lower print frame 38 and carries a web of the print media 11 about a media spool 43. As is appreciated by one skilled in the art, the roll assembly 46 may comprise a variety of print media 11, such as adhesive labels or plain paper.

Attached to the upper print frame 36 are the ribbon cartridge 50 and a print head 52. The print head 52 is moveably coupled to a bracket 54 such that the print head 52 is biased toward the drive roller 47 by a group of springs 49 when the upper print frame 36 is in the closed position (shown best in FIG. 4). The ribbon cartridge 50 is secured to the upper print frame 36 by a pair of clips 51 that extend from the ribbon cartridge 50 and snap-fit into a pair of notches 53 formed in the upper print frame 36.

The ribbon cartridge 50 includes a supply spool 56 and a take-up spool 58 that are rotatably coupled to a ribbon 57. With specific reference to FIG. 3, the supply spool 56 includes a supply spool gear 64 and the take-up spool 58 includes a take-up spool gear 66. The supply spool gear 64 and the take-up spool gear 66 are selectively engaged to drive the ribbon 57 either downstream (i.e., from the supply spool 56 to the take-up spool 58) or upstream (i.e., from the take-up spool 58 to the supply spool 56) depending on the direction of rotation of the drive motor 45. When the upper print frame 36 is in the closed position (e.g., shown in FIG. 2), the supply spool 56 rotatably rides in a pair of supply spool saddles 68 formed in the lower print frame 38 and the take-up spool 58 rotatably rides in a pair of take-up spool saddles 70 also formed in the lower print frame 38 (best shown in FIG. 3).

The ribbon 57 (shown only in FIG. 4 for clarity) can be unwound from the supply spool 56 during printing, fed downstream toward the print head 52, and then wound to the take-up spool 58. Alternatively, the ribbon 57 can be unwound from the take-up spool 58, back-fed upstream toward the supply spool 56, and rewound to the supply spool 56. As noted, providing and maintaining the appropriate tension in the ribbon 57 during and between the downstream and upstream movement of the ribbon 57 helps maintain print quality.

With specific reference to FIG. 4, the engagement between the print head 52 and the drive roller 47 establishes a nip pressure on the print media 11 and the ribbon 57 as each passes between the print head 52 and the drive roller 47. The nip pressure ensures a sufficient amount of friction between the print media 11/ribbon 57 and the drive roller 47 to allow the drive roller 47 to translate the print media 11 and ribbon 57 downstream and upstream of the print head 52 as required.

During printing, the print media 11 moves along a path 60 (best shown in FIG. 4) that extends adjacent the print head 52 and drive roller 47. As the print media 11 and ribbon 57 pass between the print head 52 and the drive roller 47, the print head 52 is selectively heated to apply heat to the ribbon 57 causing the print material (e.g., ink) to be transferred from the ribbon 57 to the print media 11. The print head 52 includes the various components of a thermal transfer print head, such as heating elements allowing for the selective heating of the print head 52, associated control circuitry, a heat sink for the dissipation of the heat from the print head 52, and the like, that are known to those skilled in the art.

The translation of the print media 11 and the driving of the supply spool 56 and take-up spool 58 are controlled by the controller. The controller is also in communication with an upstream sensor 96 and a downstream sensor 62 to detect the presence of the print media 11 along the path 60. As best shown in FIGS. 3 and 4, the upstream sensor 96 is positioned upstream of the drive roller 47 to detect the print media 11 prior to engaging the print head 52. The downstream sensor 62 is positioned downstream of the drive roller 47 to detect the print media 11 and prevent excessive back-feeding of the print media 11 that results in a loss of nip pressure. The upstream sensor 96 and the downstream sensor 62 may be configured to detect the presence of the print media 11 and/or any variation of indices (not shown) thereon, thus allowing the controller to establish the relative position between the print media 11 and the print head 52. Additional detail concerning the upstream sensor 96, downstream sensor 62, and the associated printer control is found in related U.S. application Ser. No. 61/061,412, filed Jun. 13, 2008, which is hereby incorporated by reference as if fully set forth herein.

With the operation of the printer 10 described generally, the configuration, structure, and operation of the drive train 44 is discussed in detail. The drive train 44 has four main functions. First, the drive train 44 drives the ribbon 57 either upstream or downstream relative to the print head 52 by selectively engaging the supply spool 56 and take-up spool 58, respectively. Second, the drive train 44 provides a delay between rotation of the drive motor 45 and the drive roller 47 while concurrently imparting an initial tension in the ribbon 57. Third, the drive train 44 provides and maintains the appropriate ribbon tension via the driven spool (i.e., either the supply spool 56 or the take-up spool 58, whichever is being driven by the drive motor 45) by overdriving the driven spool to prevent slack in the ribbon 57 and allowing slip (i.e., relative rotation of selected gears) to limit the maximum tension in the ribbon 57. Fourth, the drive train 44 provides and maintains sufficient drag tension on the ribbon 57 via the non-driven spool (i.e., the supply spool 56 or the take-up spool 58 that is driven by the unwinding of ribbon 57) by imparting resistance to the rotation of the non-driven spool via selected gears. Notably, the ribbon cartridge 50 of the example embodiment does not include any type of tensioning element; the tension of the ribbon 57 is independently provided and maintained by the drive train 44. However, internal tensioning elements may be incorporated if desired.

The drive train 44 incorporates three main components to provide the various functions discussed above. A drive direction assembly 72 transfers rotation of the drive motor 45 between the supply spool gear 64 and the take-up spool gear 66 during a change in the direction of rotation of the drive motor 45, while simultaneously providing a delay between the rotation of the drive motor 45 and the drive roller 47 to pre-tension the ribbon 57. A take-up drag-overrun assembly 78 and a similar supply drag-overrun assembly 80 provide drag and overrun functions depending on location and direction of the drive motor 45. And, a take-up slip-overdrive assembly 74 and a similar supply slip-overdrive assembly 76 provide slip and overdrive functions depending on location and direction of the drive motor 45.

Figure 6:
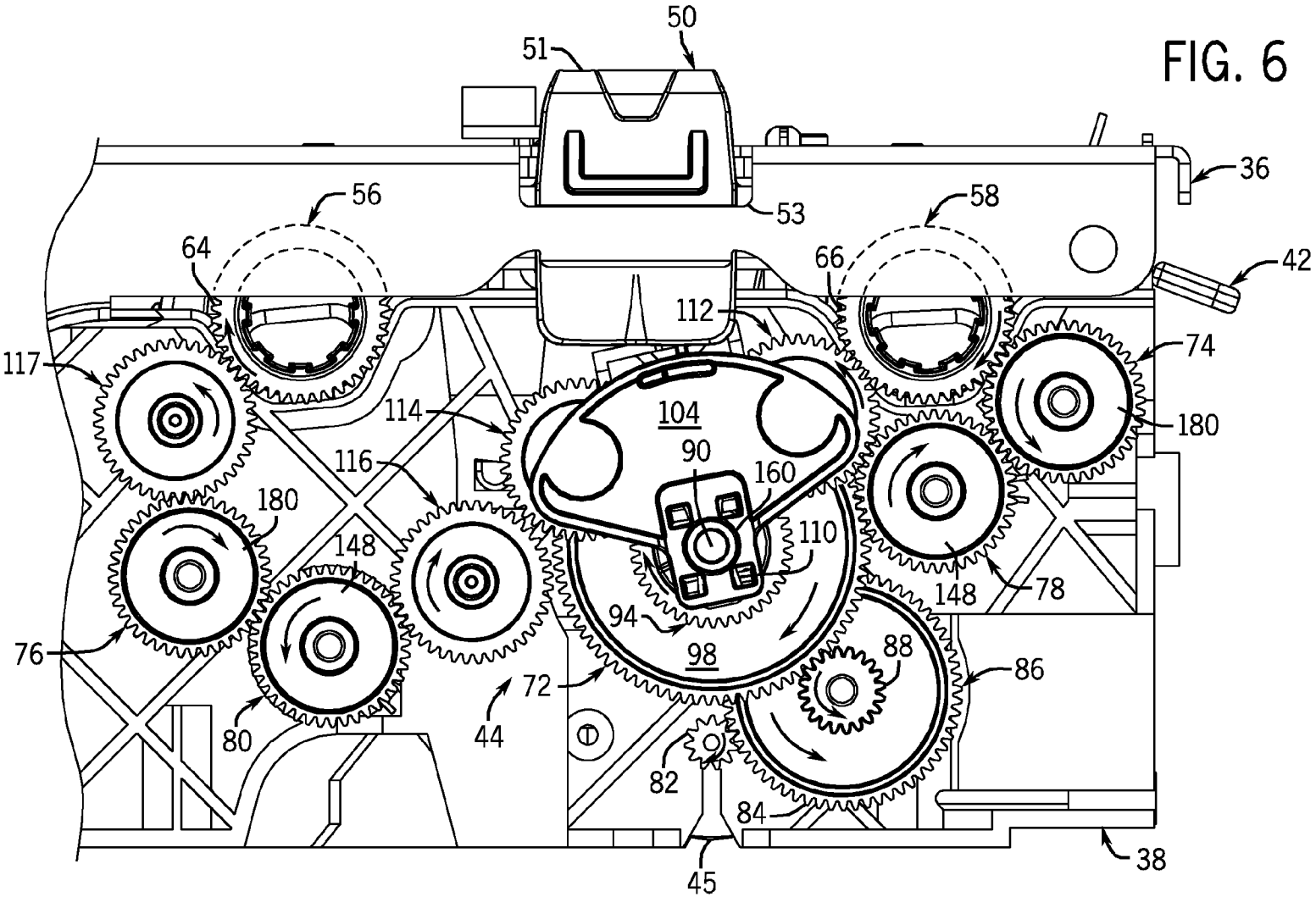
FIG. 6 is a partial side plan view of the drive train of FIG. 5 shown driving a take-up spool in the downstream direction.
Figure 7:
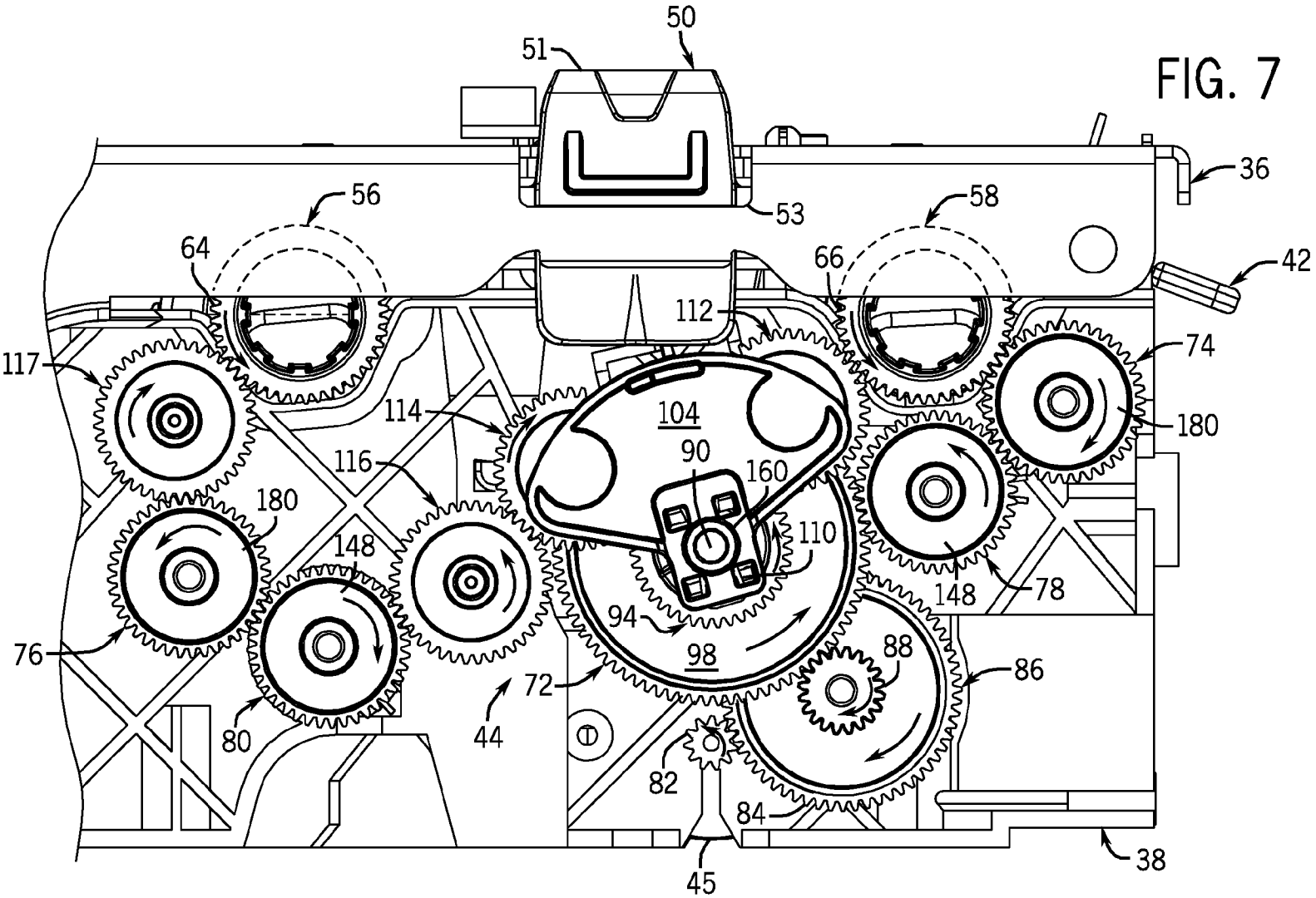
FIG. 7 is a partial side plan view similar to FIG. 6 shown driving a supply spool in the upstream direction.
Figure 8:
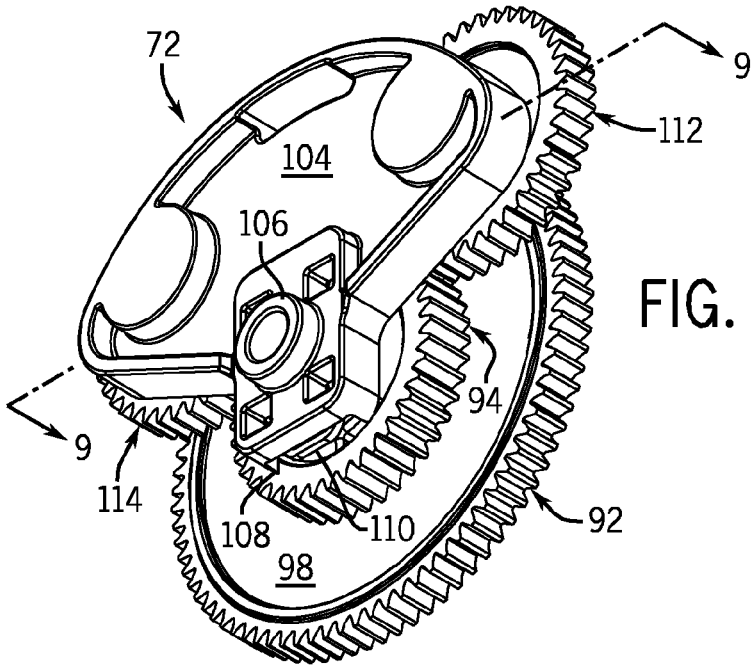
FIG. 8 is an isometric view showing a drive direction assembly in accordance with the present invention.
Figure 9:
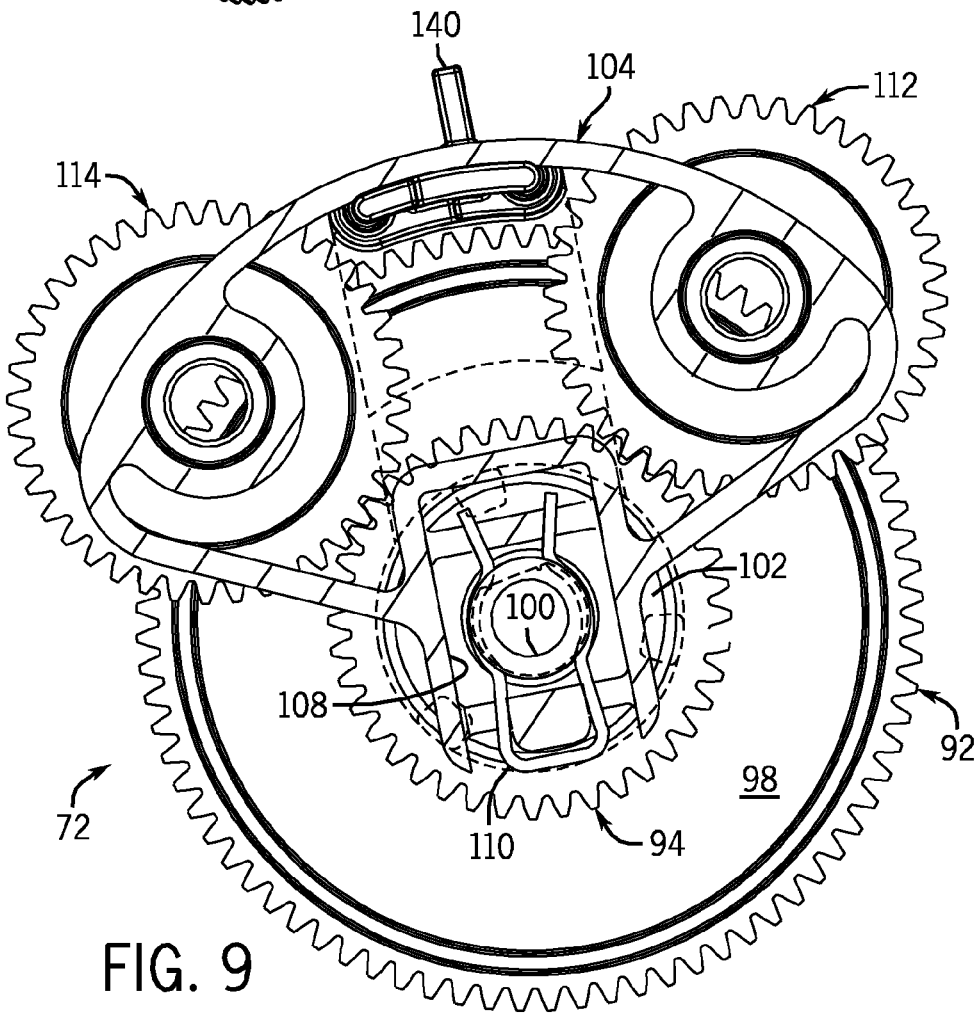
FIG. 9 is a partial side plan view of the drive direction assembly of FIG. 8.

In general, FIG. 6 shows the drive direction assembly 72 in the downstream direction configuration (i.e., the ribbon 57 is transferred from the supply spool 56 to the take-up spool 58) while FIG. 7 shows the drive direction assembly 72 reversed in the upstream direction configuration (i.e., the ribbon is transferred from the take-up spool 58 back to the supply spool 56). As noted above, the drive direction assembly 72 can toggle between the downstream and upstream direction configurations in response to the rotation of the drive motor 45 (e.g., a stepper motor).

The operation of the drive train 44 is best understood by mapping the engagement between the various gears of the drive train 44. However, as one skilled in the art will appreciate, a variety of gear ratios and configurations are possible to implement the present invention and are dependent upon the specific application requirements.

For purposes of explanation, the operation and force transfer of the drive train 44 begins with the assumption that the drive direction assembly 72 is originally in the upstream direction configuration shown in FIG. 7. During operation, the controller (not shown) signals the drive motor 45 to rotate in the appropriate direction, in the present example, the drive motor 45 is rotated in the clockwise direction, as shown in FIG. 6, to ultimately drive the take-up spool gear 66 and thus transfer the ribbon 57 from the supply spool 56 to the take-up spool 58.

The drive motor 45 is coupled to and rotates a drive motor gear 82 that meshes with an outer reduction gear 84 of a reduction gear assembly 86. A coaxial inner reduction gear 88 rotates in unison with the outer reduction gear 84 in a counterclockwise direction, effectively reducing the angular velocity of the drive train 44 as compared to the drive motor 45. The inner reduction gear 88 then meshes with the drive direction assembly 72.

The force supplied by the inner reduction gear 88 of the reduction gear assembly 86 causes the drive direction assembly 72 to toggle from the upstream direction configuration (shown in FIG. 7) to the downstream direction configuration (shown in FIG. 6) due to friction between components of the drive direction assembly 72. With additional reference to FIGS. 8-11, the components of the drive direction assembly 72 are shown in greater detail. The inner reduction gear 88 engages an outer drive gear 92 causing the outer drive gear 92 to rotate in the clockwise direction. An inner drive gear 94 having a drive gear hub 100 that extends axially away from a first inner drive gear face 102 is fixed to the outer drive gear 92 adjacent a first outer drive gear face 98 such that the outer drive gear 92 and inner drive gear 94 both rotate in response to the rotation of the inner reduction gear 88.

A direction arm 104 includes a direction arm hub 106 and a spring clip slot 108 that extends proximate the direction arm hub 106. The direction arm hub 106 is fit over the drive gear hub 100, and then a spring clip 110 is inserted in the spring clip slot 108 to ride along drive gear hub 100. Therefore, rotation of the outer drive gear 92, inner drive gear 94, and drive gear hub 100 causes the direction arm 104 to rotate along with the drive gear hub 100 due to the frictional engagement of the spring clip 110 with the drive gear hub 100. The direction arm 104 rotates until the downstream drive gear 112 that is rotatably coupled to the direction arm 104 meshes with the take-up drag-overrun assembly 78, ultimately resulting in the take-up spool 58 being driven.

Similarly, reversing direction of the drive motor 45 to a counterclockwise rotation will result in the direction arm 104 rotating with the drive gear hub 100 in the counterclockwise direction (shown in FIG. 7) until an upstream drive gear 114, also rotatably coupled to the direction arm 104, meshes with an idler gear 116 engaged with the supply drag-overrun assembly 80. In this direction the supply spool 56 is ultimately driven to rewind the ribbon 57 onto the supply spool 56.

As a result of the above operation shown in FIG. 6, the downstream drive gear 112 is causing rotation of the take-up spool 58 and therefore providing tension in the ribbon 57. Notably, the drive direction assembly 72 has not yet caused rotation of the coupled drive roller 47—thus, the ribbon 57 is being tensioned prior to printing.

Figures 10, 11:
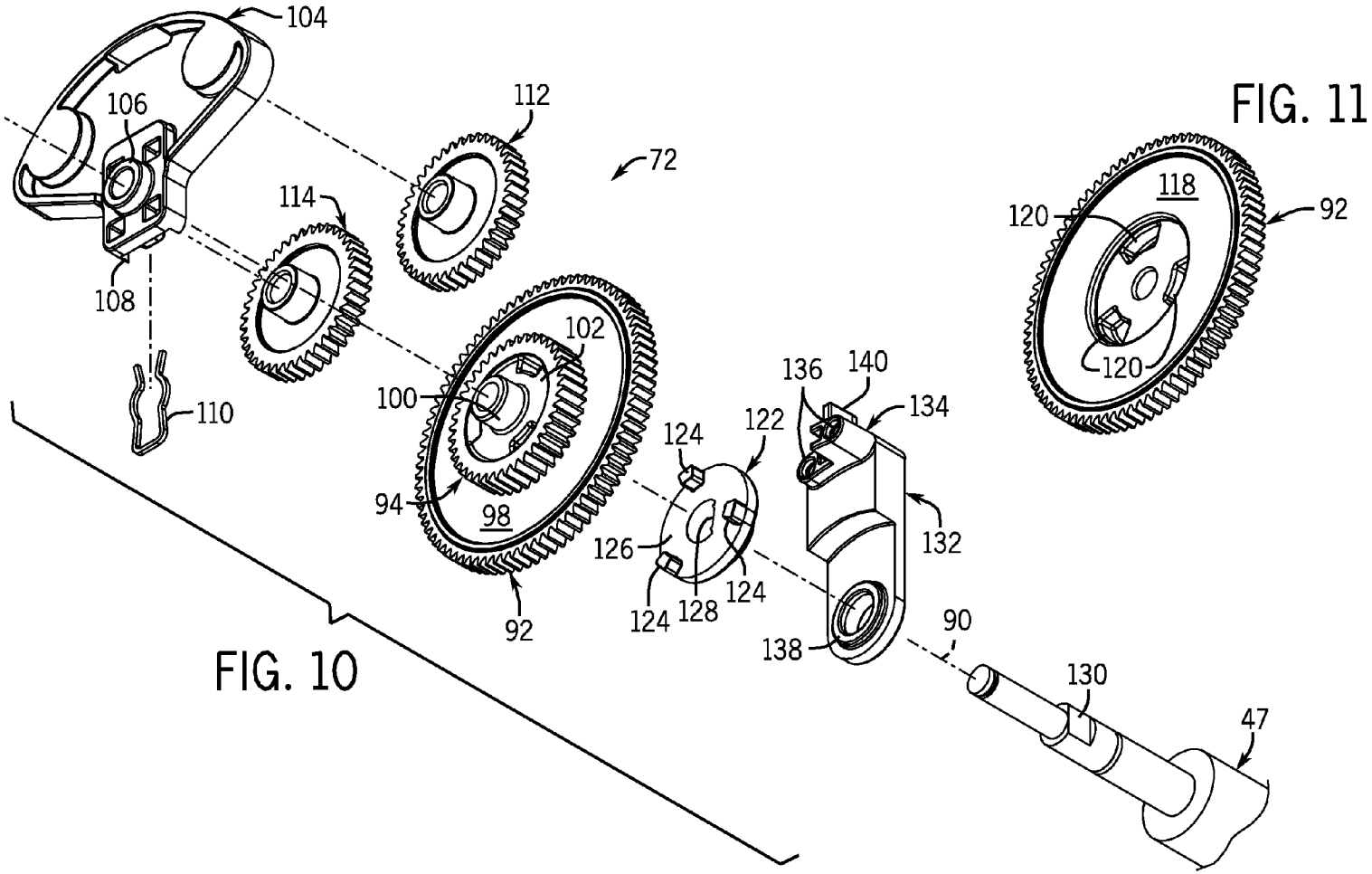
FIG. 10 is an exploded perspective view of the drive direction assembly of FIG. 8.
FIG. 11 is a perspective view of an outer drive gear of FIG. 8.

With continued reference to FIGS. 10 and 11, a delay disk 122 imparts a delay between the rotation of the drive motor 45 and the drive roller 47 allowing sufficient rotation of the supply spool 56 or take-up spool 58, depending on drive direction, to properly tension the ribbon 57. A second outer drive gear face 118 includes a plurality of equally spaced slots 120 extending circumferentially. The delay disk 122 has a plurality of protrusions 124 that extend from a delay disk face 126 to mate with the slots 120. The slots 120 and protrusions 124 are sized such that the outer drive gear 92 rotates relative to the delay disk 122 momentarily after the downstream drive gear 112 has initiated rotation of the take-up spool 58. Once the protrusions 124 engage the ends of the slots 120, a delay disk notch 128 coupled to the drive roller 47 via a drive roller notch 130 transfers rotation to the drive roller 47 to rotate the drive roller about the drive axis 90.

Figure 17:
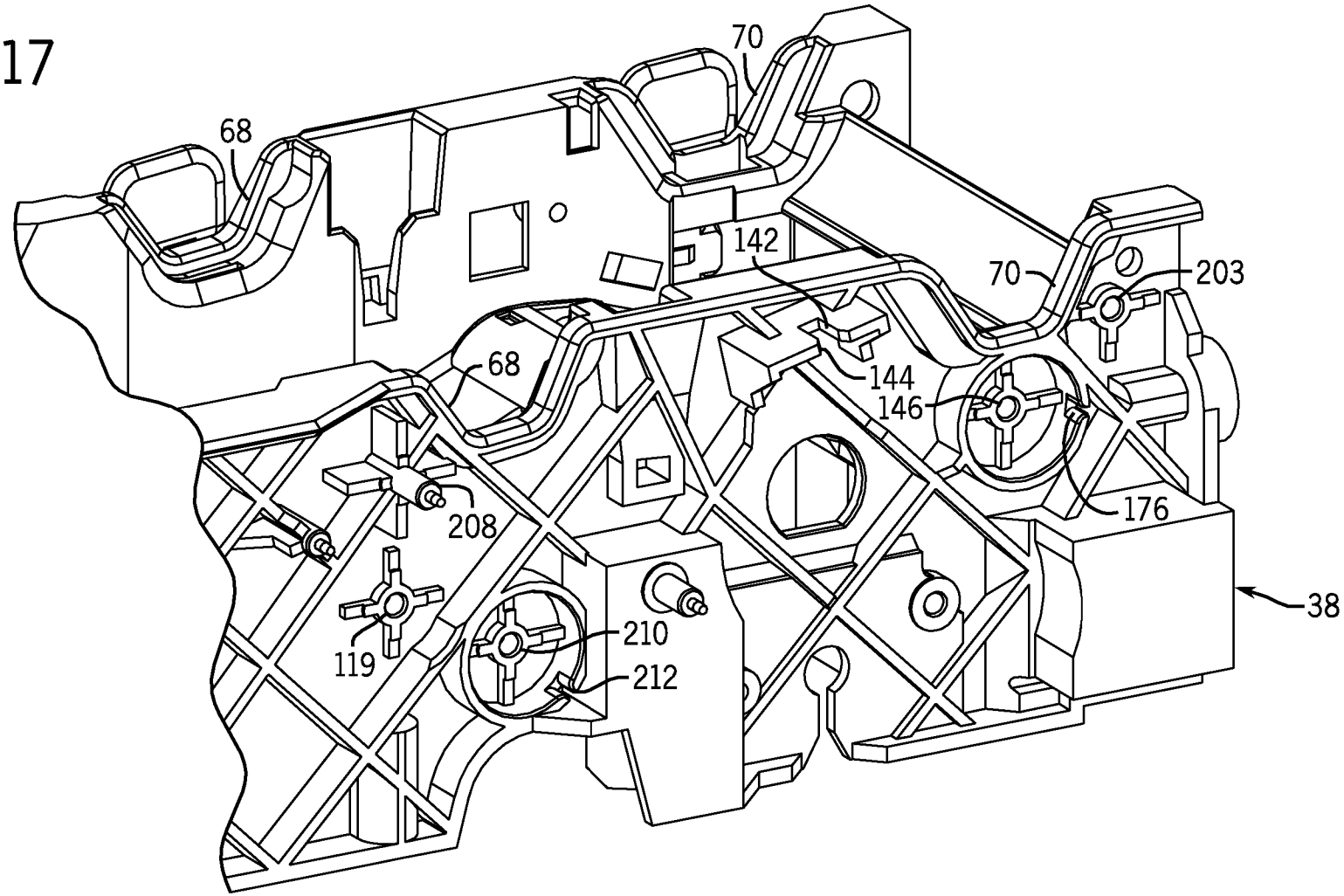
FIG. 17 is a partial perspective view of the lower print frame of FIG. 1 showing the drive train removed.

The drive direction assembly 72 further includes a back leg 132 that captures the delay disk 122 to the second outer drive gear face 118 via a snap fitting 134. The snap fitting 134 has a pair of bores 136 that receive mating posts (not shown) extending from the direction arm 104. The back leg 132 also includes a bore 138 aligned with the drive axis 90 when installed proximate the drive roller 47. A tab 140 extends from an end of the back leg 132 to prevent over-rotation of the drive direction assembly 72 as the tab 140 bears against a downstream notch face 142 formed in the lower print frame 38 (shown in FIG. 17) when in the downstream direction configuration of FIG. 6. Alternatively, the tab 140 bears against an upstream notch face 144 when the drive direction assembly 72 is oriented in the upstream direction configuration of FIG. 7. Many variations in the configuration and relative gear ratios of the drive direction assembly 72 will be appreciated by one skilled in the art in light of the present teachings.

With the drive direction assembly 72 toggled to the downstream direction configuration, we return to FIG. 6 as the downstream drive gear 112 meshes with the take-up drag-overrun assembly 78 to rotate the take-up drag-overrun assembly 78 in the clockwise direction as shown. The take-up drag-overrun assembly 78 is configured such that rotation in the clockwise direction results in the take-up drag-overrun assembly 78 operating generally as an idler gear, that is, simply transferring rotation from the downstream drive gear 112 to the take-up slip-overdrive assembly 74.

With reference to FIGS. 12-14 and 17, the take-up drag-overrun assembly 78 is rotatably coupled to the lower print frame 38 at opening 146 (shown in FIG. 17) via a spindle 147 and meshed with the downstream drive gear 112. The take-up drag-overrun assembly 78 includes a drag-overrun gear 148 defining a slot 150 along a standoff 152. A hub 154 is rotatably mounted adjacent the standoff 152 and includes an outer surface 156 and an inner surface 158. An inner torsion spring 160 includes a drive leg 162 and a free leg 164, preferably at the ends of the torsion spring 160. The inner torsion spring 160 is installed into the hub 154 such that the inner torsion spring 160 bears against the inner surface 158 to provide an outward radial force generating frictional engagement that resists relative rotation between the inner torsion spring 160 and the inner surface 158.

Figures 12, 13, 14:
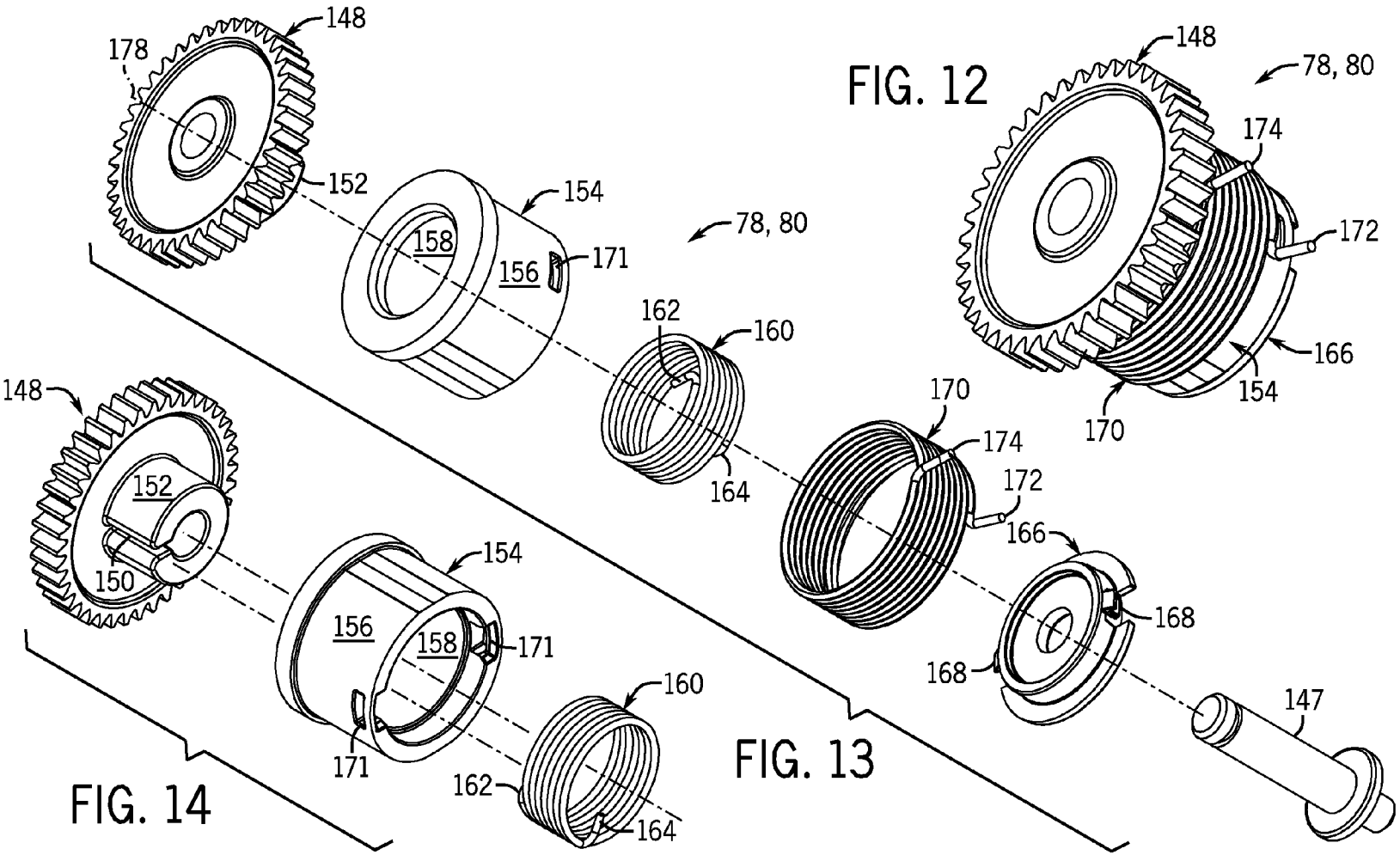
FIG. 12 is a perspective view of a drag-overrun assembly in accordance with the present invention.
FIG. 13 is an exploded perspective view of the drag-overrun assembly of FIG. 12.
FIG. 14 is a partial exploded perspective view of the drag-overrun assembly of FIG. 12.

To install the inner torsion spring 160, the inner torsion spring 160 is wound and the drive leg 162 is aligned with the slot 150 in the standoff 152 (as shown in FIG. 14) such that rotation of the drag-overrun gear 148 will urge the inner torsion spring 160 in either the wound direction (i.e., to decrease the diameter of the inner torsion spring 160 and hence decrease the outward radial force against the inner surface 158 of the hub 154, thereby decreasing friction between the inner torsion spring 160 and the inner surface 158 of the hub 154) or in the unwound direction (i.e., to increase the diameter of the inner torsion spring 160 and hence increase the outward radial force against the inner surface 158 of the hub 154, thereby increasing friction between the inner torsion spring 160 and the inner surface 158 of the hub 154). An end cap 166 has a pair of clips 168 that snap into openings 171, helping to retain the inner torsion spring 160 in the hub 154.

An outer torsion spring 170 includes a fixed leg 172 and a free leg 174 and is unwound before being slid over the outer surface 156 of the hub 154. The outer torsion spring 170 generally provides an inward radial force that causes friction between the outer torsion spring 170 and the outer surface 156 of the hub 154. When the take-up drag-overrun assembly 78 is installed to the lower print frame 38, the fixed leg 172 is slid into a recess 176 (shown in FIG. 17) to prevent the fixed leg 172 end from rotating about a drag-overrun axis 178. The configuration allows the outer torsion spring 170 to be urged in either the wound direction to increase the friction between the outer torsion spring 170 and the outer surface 156 of the hub 154 or the unwound direction to decrease the friction between the outer torsion spring 170 and the outer surface 156 of the hub 154, thereby allowing the hub 154 to rotate relative to the outer torsion spring 170 and thus lower print frame 38.

Returning to FIG. 6, and in view of FIGS. 12-14 and 17, when the downstream drive gear 112 drives the drag-overrun gear 148 of the take-up drag-overrun assembly 78 in the clockwise direction, the slot 150 of the drag-overrun gear 148 rotates in a direction tending to urge the inner torsion spring 160 to unwind, thereby increasing the outward radial force of the inner torsion spring 160 applied to the inner surface 158 of the hub 154. This increased outward radial force allows the drag-overrun gear 148 and hub 154 to rotate substantially in unison in the clockwise direction. The clockwise direction of the hub 154 further imparts a frictional force on the outer torsion spring 170 in the clockwise direction to urge the outer torsion spring 170 to unwind, thus reducing the inward radial force supplied by the outer torsion spring 170 to the outer surface 156 of the hub 154 and allowing the hub 154 to rotate in the clockwise direction. As a result, when rotating as shown in FIG. 6, the take-up drag-overrun assembly 78 allows the drag-overrun gear 148 to generally transfer rotation of the downstream drive gear 112 to the take-up slip-overdrive assembly 74 with minimal impediment.

Returning again to FIG. 6, the take-up drag-overrun assembly 78, specifically the drag-overrun gear 148, transfers rotation to the take-up slip-overdrive assembly 74 that ultimately engages the take-up spool gear 66 thereby winding the ribbon 57 about the take-up spool 58. The function of the take-up slip-overdrive assembly 74 when rotated counterclockwise as shown in FIG. 6 is to eliminate slack in the ribbon 57 by driving the take-up spool 58 at a rate that winds ribbon 57 about the take-up spool 58 faster than it is fed by the drive roller 47. Moreover, the take-up slip-overdrive assembly 74 includes a slipping feature to maintain the requisite tension in the ribbon 57 without imparting an excessive amount that may damage the ribbon 57.

Figure 5:
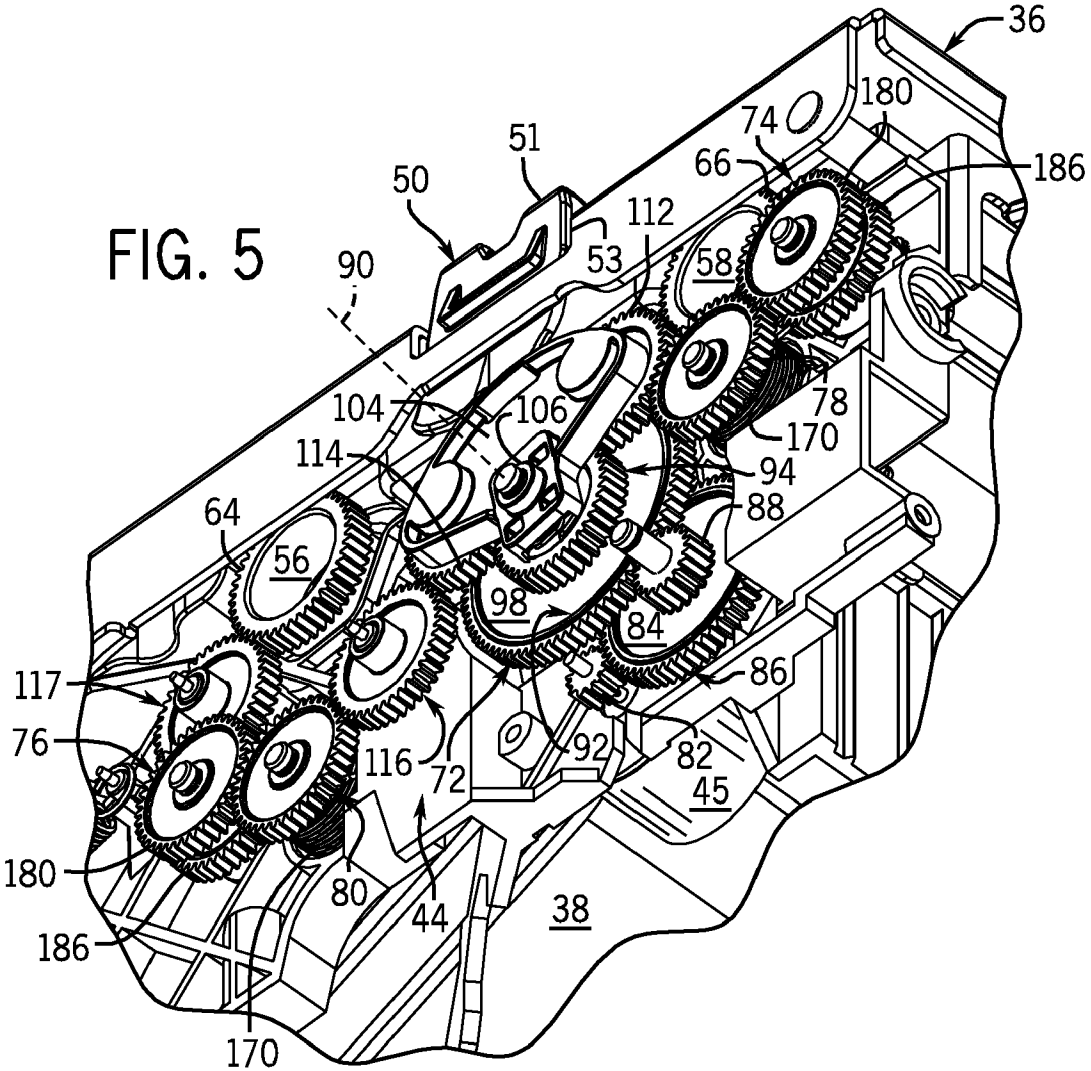
FIG. 5 is a partial isometric view of a drive train in accordance with the present invention.
Figures 15, 16:
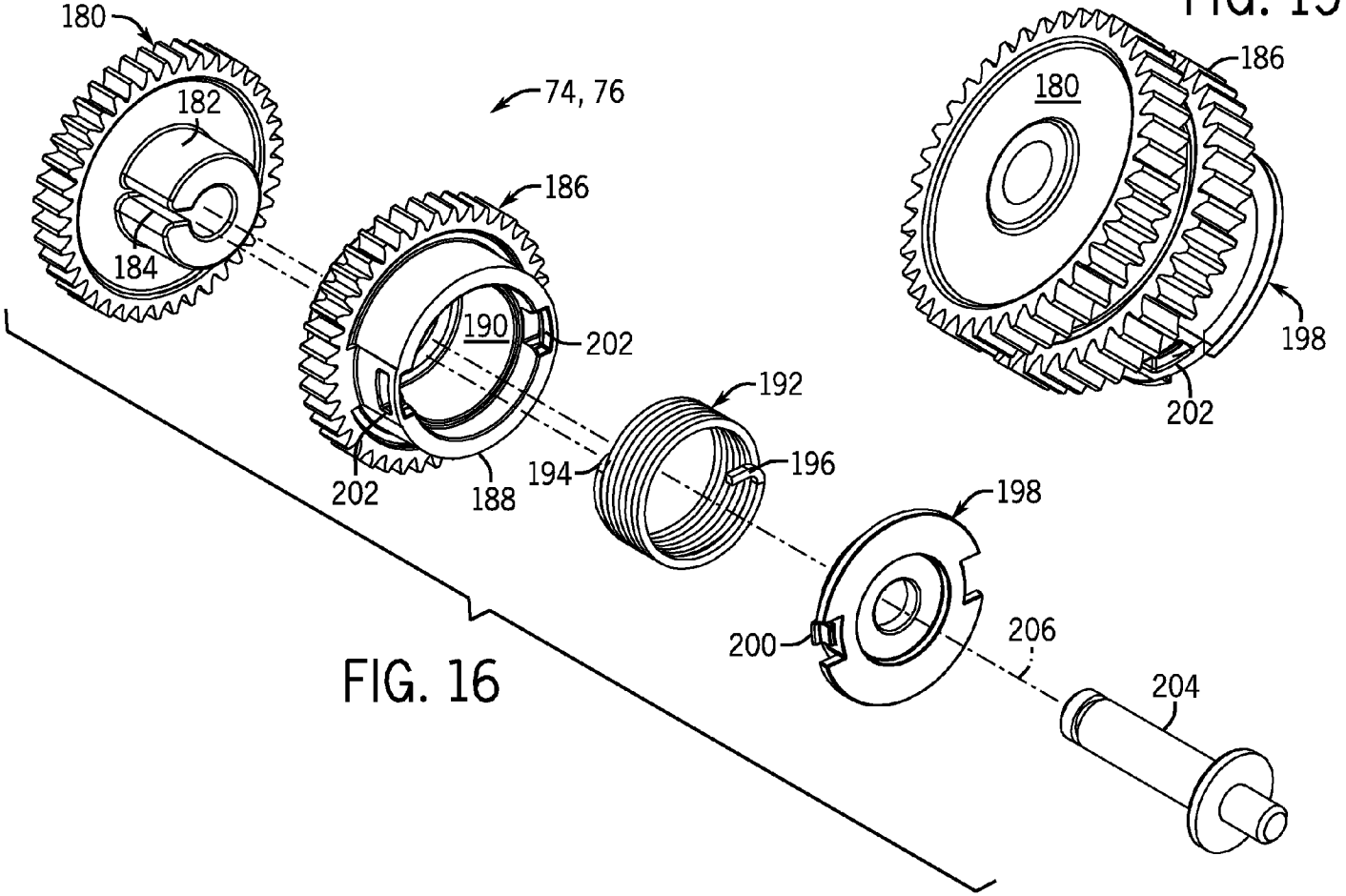
FIG. 15 is a perspective view of a slip-overdrive assembly in accordance with the present invention.
FIG. 16 is an exploded perspective view of the slip-overdrive assembly of FIG. 15.

With additional reference to FIGS. 5 and 15-16, the take-up slip-overdrive assembly 74 includes an outer slip-overdrive gear 180, similar to the drag-overrun gear 148, which is meshed with the drag-overrun gear 148 to transmit rotation to the take-up slip-overdrive assembly 74. The outer slip-overdrive gear 180 includes a standoff 182 having a slot 184. An inner slip-overdrive gear 186 is aligned adjacent the outer slip-overdrive gear 180 and defines a bore 188 having an inner surface 190. A torsion spring 192 includes a gear leg 194 and a free leg 196. As with the take-up drag-overrun assembly 78, the torsion spring 192 is wound to frictionally fit the torsion spring 192 to the inner surface 190 of the bore 188. The gear leg 194 of the torsion spring 192 is aligned during installation with the slot 184 such that the gear leg 194 is linked to the rotation of the outer slip-overdrive gear 180. An end cap 198 is secured via clips 200 in openings 202 to help axially restrain the torsion spring 192. The take-up slip-overdrive assembly 74 is rotatably coupled to the lower print frame 38 about spindle 204, which is engaged with opening 203, allowing the take-up slip-overdrive assembly 74 to selectively rotate about a slip-overdrive axis 206.

In operation, as the outer slip-overdrive gear 180 is driven counterclockwise by the drag-overrun gear 148, the slot 184 of the outer slip-overdrive gear 180 will urge the torsion spring 192 in a direction tending to wind the torsion spring 192 and therefore decrease the friction between the torsion spring 192 and the inner surface 190 of the inner slip-overdrive gear 186. However, the friction between the torsion spring 192 and the inner surface 190 is sufficient to drive the take-up spool gear 66 so as to produce the desired amount of tension in the ribbon 57. As the tension in the ribbon 57 increases, given that the drive train 44 is geared such that the take-up spool 58 winds ribbon 57 faster than it is fed by the drive roller 47, the friction between the torsion spring 192 and the inner surface 190 of the inner slip-overdrive gear 186 is overcome by the resistance caused by the tension in the ribbon 57. Thus, the torsion spring 192 slips relative to the inner slip-overdrive gear 186 to allow the outer slip-overdrive gear 180 and the inner slip-overdrive gear 186 to rotate at different rates. As a result, the outer slip-overdrive gear 180 maintains the rate of the drag-overrun gear 148 and the inner slip-overdrive gear 186 is allowed to decrease the rate of rotation of the take-up spool 58 ultimately maintaining the desired tension in the ribbon 57. The configuration also accommodates for the pre-tension imparted at the start of a printing cycle before the drive roller 47 is rotationally engaged by the drive direction assembly 72.

Notably, the engagement between the take-up spool gear 66 and the inner slip-overdrive gear 186 results in a force component biasing the take-up spool 58 toward the take-up spool saddles 70. This is accomplished by arranging the take-up spool gear 66 and the inner slip-overdrive gear 186 such that the meshing forces, in sum, establish the biasing force. This biasing force is achieved in either direction of rotation as shown in FIGS. 6 and 7.

With the issue of providing and maintaining tension in the ribbon 57 downstream of the drive roller 47 addressed, we return again to FIG. 6 to illustrate how a pair of idler gears 116, 117 in conjunction with the supply slip-overdrive assembly 76 and supply drag-overrun assembly 80 provide and maintain the desired tension in the ribbon 57 upstream of the drive roller 47. As noted above, the ribbon 57 is being unwound from the supply spool 56 in response to the drive roller 47 engaging the print media 11 proximate the print head 52. Without the proper drag or upstream tension on the ribbon 57, the ribbon 57 may become slack causing a variety of printing problems.

As the ribbon 57 is unwound from the supply spool 56, the supply spool 56 rotates clockwise as shown in FIG. 6. The supply spool gear 64 engages an idler gear 117 that is free to rotate about a post 208 extending from the lower print frame 38. In addition to altering the direction of rotation of the supply spool 56, the idler gear 117 is similarly located to ensure that the engagement between the supply spool gear 64 and the idler gear 117 results in a force component biasing the supply spool 56 toward the supply spool saddles 68 (shown best in FIG. 17). Again, this is accomplished by arranging the supply spool gear 64 and the idler gear 117 such that the meshing forces, in sum, establish the biasing force. As with the engagement between the take-up spool gear 66 and the inner slip-overdrive gear 186, this biasing force is achieved in either direction of rotation as shown in FIGS. 6 and 7.

The counterclockwise rotation of the idler gear 117 is transferred to the supply slip-overdrive assembly 76, which is rotatably coupled to the lower print frame 38 via spindle 204 at opening 119, to rotate the supply slip-overdrive assembly 76 in a clockwise direction, thus opposite to the direction of rotation of the take-up slip-overdrive assembly 74. The supply slip-overdrive assembly 76 functions similar to a stacked idler gear generally transferring rotation from the idler gear 117 to the supply drag-overrun assembly 80.

With specific reference to FIGS. 5 and 15-16, the idler gear 117 meshes with and drives the inner slip-overdrive gear 186. The interaction between the inner slip-overdrive gear 186 and the outer slip-overdrive gear 180 tends to cause the torsion spring 192 to compress or wind, therefor decreasing the outward radial force supplied by the torsion spring 192 on the inner surface 190. However, the outward radial force supplied by the torsion spring 192 is sufficient to allow the outer slip-overdrive gear 180 and the inner slip-overdrive gear 186 to rotate substantially in unison, even after the reduction in outward radial force. In other words, the torque supplied by the driven supply spool 56 is insufficient to result in slip between the torsion spring 192 and the inner slip-overdrive gear 186, thus preventing relative movement between the inner slip-overdrive gear 186 and the outer slip-overdrive gear 180.

The supply drag-overrun assembly 80 functions in the downstream direction configuration (shown in FIG. 6) to provide drag or resistance in response to the unwinding of ribbon 57 from the supply spool 56, therefore providing and maintaining a sufficient tension in the ribbon 57 to minimize printing issues related to excess slack or insufficient tension in the ribbon 57 upstream of the print head 52. With reference again to FIGS. 5, 6, and 12-14, the outer slip-overdrive gear 180 meshes with the drag-overrun gear 148 resulting in counterclockwise rotation of the drag-overrun gear 148. The supply drag-overrun assembly 80 is rotatably coupled to the lower print frame 38 at opening 210 via spindle 147. The counterclockwise rotation of the drag-overrun gear 148 causes the inner torsion spring 160, which is linked to the drag-overrun gear 148 via drive leg 162, to compress or wind in a direction resulting in a decrease in, although not an elimination of, the outward radial force supplied by the inner torsion spring 160 on the inner surface 158 of the hub 154. At the same time, the outer torsion spring 170, having a fixed leg 172 rotationally restrained in recess 212, is being urged in a direction tending to increase the inward radial force supplied by the outer torsion spring 170 on the outer surface 156 of the hub 154, thereby preventing the hub 154 from rotating relative to the lower print frame 38 and inner torsion spring 160.

Friction between the inner torsion spring 160 and the inner surface 158 causes resistance or drag as the drag-overrun gear 148 rotates in the counterclockwise direction, as a result, the supply spool 56 is prevented from freewheeling as the ribbon 57 is unwound. Additionally, a tension is provided and maintained in the ribbon 57 while the supply slip-overdrive assembly 76 may be configured to slip prior to the tension in the ribbon 57 reaching a damaging level. For completeness, the drag-overrun gear 148 meshes with the idler gear 116 in the downstream drive configuration shown in FIG. 6, however, the idler gear 116 is not engaged with the upstream drive gear 114 in this configuration.

Changing the direction of rotation of the drive motor 45 alters the operation of the drive train 44 such that the supply spool 56 is driven and the take-up spool 58 is unwound by the ribbon 57. However, the drive train 44 is configured such that the appropriate tension is provided and maintained in the ribbon 57 in either the downstream drive configuration or the upstream drive configuration.

The function and operation of the drive train 44 is dependent on the direction of the drive motor 45 and thus the rotation of each component. More specifically, when the direction of the drive motor 45 is reversed (e.g., from the downstream driving configuration of FIG. 6 to the upstream driving configuration of FIG. 7) the function of the related components are swapped. For example, beginning with the assumption that the drive direction assembly 72 is in the downstream driving configuration shown in FIG. 6, reversing the rotation of the drive motor 45 to the counterclockwise direction shown in FIG. 7 causes the direction arm 104 to rotate about the drive axis 90 due to the frictional engagement of the spring clip 110 discussed above. The upstream drive gear 114 meshes with and drives the idler gear 116, ultimately driving the supply spool 56 in a counterclockwise direction to wind ribbon 57 back on the supply spool 56. Again, the delay disk 122 ensures proper tension on the ribbon 57 before the drive roller 47 is engaged.

With specific reference to FIGS. 6 and 7, it is shown that the rotation of the gears have been reversed by use of idler gears 116, 117. Specifically, the rotation (and thus function in the driven direction shown in FIG. 7) is swapped from that illustrated in FIG. 6 to provide and maintain the appropriate tension in the ribbon 57 when the ribbon 57 is being transferred from the take-up spool 58 to the supply spool 56. The supply slip-overdrive assembly 76 now rotates in the counterclockwise direction (similar to the take-up slip-overdrive assembly 74 in the downstream drive configuration of FIG. 6) and the take-up slip-overdrive assembly 74 now rotates in the clockwise direction (similar to the supply slip-overdrive assembly 76 in the downstream drive configuration of FIG. 6). Similarly, the supply drag-overrun assembly 80 now rotates in the clockwise direction (similar to the take-up drag-overrun assembly 78 in the downstream drive configuration of FIG. 6) and the take-up drag-overrun assembly 78 now rotates in the counterclockwise direction (similar to the supply drag-overrun assembly 80 in the downstream drive configuration of FIG. 6).

In general, changing the direction of rotation of the drive train 44, and hence drive train 44 components, results in the structurally related components (i.e., the take-up slip-overdrive assembly 74 and the related supply slip-overdrive assembly 76, and the take-up drag-overrun assembly 78 and the related supply drag-overrun assembly 80) providing complementary functions in the respective downstream drive configuration and the upstream drive configuration. As a result, the drive train 44 provides and maintains the desired tension on the ribbon 57 in both operating configurations.

In light of the above, the present invention provides a printer drive train 44 that provides and maintains sufficient tension on the ribbon 57 to prevent excess slack in the ribbon 57. The drive train 44 provides a delay between engagement of the driven spool and the drive roller 47 to allow the ribbon 57 to be pre-tensioned prior to a printing or back-feeding. Furthermore, the drive train 44 provides tension on the ribbon 57 with both overdriving and dragging selected gears depending on the rotation of the drive train 44.

While there has been shown and described what is at present considered the preferred embodiment of the invention, it will be obvious to those skilled in the art that various changes and modifications can be made therein without departing from the scope of the invention defined by the following claims. For example, the outer torsion spring 170 and inner torsion spring 160 may be wound in the opposite direction and coupled to the drag-overrun gear 148 and lower print frame 38 to exchange the functionality of the outer torsion spring 170 and inner torsion spring 160 from that described in the preferred example embodiment.

Figures 18, 19:
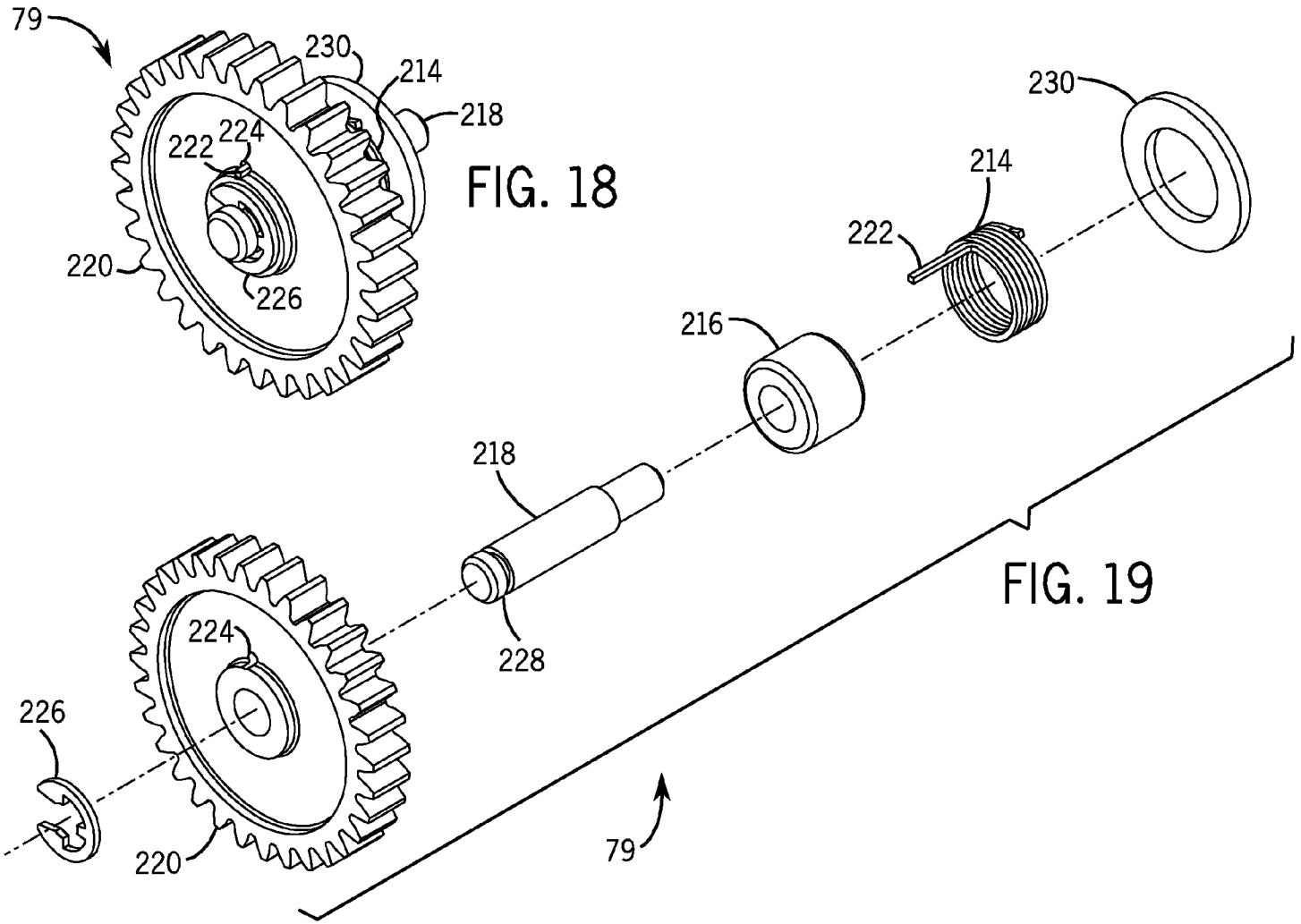
FIG. 18 is an isometric view of an alternative drag-overrun assembly.
FIG. 19 is an exploded isometric view of the drag-overrun assembly of FIG. 18.

Moreover, as illustrated in FIGS. 18 and 19, an alternative drag-overrun assembly 79 may include a torsion spring 214 frictionally engaged with a one-way clutch 216. A spindle 218 carries a gear 220 and the one-way clutch 216, and a first leg 222 of the torsion spring 214 extends into an opening 224 formed in the gear 220 such that the torsion spring 214 is urged in a wound or unwound direction about the one-way clutch 216 as the gear 220 rotates. An E-clip 226 is seated in a recess 228 formed in the spindle 218 and captures the gear 220, one-way clutch 216, and torsion spring 214 between a bearing 230 that rides along a printer frame (not shown in FIGS. 18 and 19). Rotating the alternative drag-overrun assembly 79 counterclockwise winds the torsion spring 214 and rotates the one-way clutch 216 in the freewheeling direction. Thus, in this direction, the drag-overrun assembly 79 is being overrun and simply freewheels, allowing the gear 220 to rotate substantially uninhibited. Conversely, rotating the alternative drag-overrun assembly 79 clockwise unwinds the torsion spring 214 and urges the one-way clutch 216 in the locked direction. As a result, the torsion spring 214 and coupled gear 220 slip relative to the non-rotating one-way clutch 216, thus providing drag as the gear 220 rotates. These variations, among others, are contemplated by and within the scope of the present invention.

We claim:

1. A drive train for a printer, comprising:

a drive motor for selectively driving a drive roller and a take-up spool to unwind a ribbon from a supply spool and wind the ribbon about the take-up spool, and for selectively driving the drive roller and the supply spool to unwind the ribbon from the take-up spool and wind the ribbon about the supply spool;

a take-up slip-overdrive assembly operationally engaged with the drive motor and the take-up spool to maintain a take-up tension in the ribbon downstream of the drive roller by overdriving the take-up spool relative to the drive roller to wind the ribbon about the take-up spool;

a supply drag-overrun assembly operationally engaged with the supply spool to maintain a supply tension in the ribbon upstream of the drive roller by resisting unwinding of the ribbon from the supply spool;

a supply slip-overdrive assembly operationally engaged with the drive motor and the supply spool to maintain the supply tension downstream of the drive roller by overdriving the supply spool relative to the drive roller to wind the ribbon about the supply spool;

a take-up drag-overrun assembly operationally engaged with the take-up spool to maintain the take-up tension in the ribbon upstream of the drive roller by resisting unwinding of the ribbon from the take-up spool; and a drive direction assembly operationally coupled to the drive motor and the drive roller, the drive direction assembly is pivotable between a downstream direction at which the drive motor drives the take-up spool and an upstream direction at which the drive motor drives the supply spool;

wherein when the drive direction assembly pivots between the downstream direction and the upstream direction the drive direction assembly drives the drive roller before the take-up spool and the supply spool.

2. The drive train of claim 1, wherein the drive direction assembly is pivotable about a drive axis of the drive roller between the downstream direction at which the drive motor drives the take-up spool and the upstream direction at which the drive motor drives the supply spool.

3. The drive train of claim 2, wherein the drive direction assembly further comprises:

a delay disk defining a delay disk face having at least one protrusion extending from the delay disk face, wherein the delay disk is coaxial with a drive axis of the drive roller and rotatably fixed to the drive roller;

an outer drive gear defining a first outer drive gear face and a second outer drive gear face adjacent the delay disk and including at least one slot sized to slidably receive the at least one protrusion extending from the delay disk face during relative rotation between the delay disk and the outer drive gear, wherein the outer drive gear is coaxial with the drive axis;

an inner drive gear defining a first inner drive gear face and a second inner drive gear face adjacent the first outer drive gear face, wherein the inner drive gear is coaxial with the drive axis;

a drive gear hub extending axially away from the first inner drive gear face, wherein the drive gear hub is coaxial with the drive axis;

a direction arm defining a direction arm hub rotatably engaged to the drive gear hub, wherein the direction arm hub is coaxial with the drive axis;

a downstream drive gear rotatably coupled to the direction arm and engaging the inner drive gear for selectively driving the take-up spool; and an upstream drive gear rotatably coupled to the direction arm and engaging the inner drive gear for selectively driving the supply spool;

wherein the direction arm rotates about the drive axis depending on the direction of rotation of the drive motor such that the downstream drive gear and the upstream drive gear rotate prior to the delay disk as the at least one protrusion slides along the at least one slot.

4. The drive train of claim 1, wherein at least one of the take-up slip-overdrive assembly and the supply slip-overdrive assembly further comprises:

a first gear for engaging at least one of the supply spool and the take-up spool, and defining an inner bore;

a torsion spring having a leg and frictionally fit to the inner bore to supply an outward radial force against the inner bore; and a second gear adjacent the first gear rotationally coupled to the leg of the torsion spring;

wherein relative rotation of at least one of the first gear and second gear in a first direction tends to decrease the outward radial force supplied by the torsion spring; and wherein relative rotation of at least one of the first gear and second gear in a second direction opposite to the first direction tends to increase the outward radial force supplied by the torsion spring.

5. The drive train of claim 4, wherein the first gear directly engages an idler gear that is engaged with one of the supply spool and the take-up spool.

6. The drive train of claim 1, wherein at least one of the take-up drag-overrun assembly and the supply drag-overrun assembly further comprises:

a hub having an outer surface and an inner surface;

an outer torsion spring having an outer leg and frictionally fit to the outer surface to supply an inward radial force against the outer surface;

an inner torsion spring having an inner leg and frictionally fit to the inner surface to supply an outward radial force against the inner surface; and a gear rotationally coupled to the inner leg of the inner torsion spring;

wherein when the outer leg is fixed to a printer frame, rotation of the gear by one of the supply spool and the take-up spool in a first direction tends to decrease the outward radial force supplied by the inner torsion spring and tends to increase the inward radial force supplied by the outer torsion spring, and rotation of the gear by the drive motor in a second direction opposite to the first direction tends to increase the outward radial force supplied by the inner torsion spring and tends to decrease the inward radial force supplied by the outer torsion spring.

7. The drive train of claim 1, further comprising:

a frame defining a supply spool saddle for carrying the supply spool and a take-up spool saddle for carrying the take-up spool;

wherein an arrangement of at least one of the take-up slip-overdrive assembly and the supply drag-overrun assembly urges at least one of the supply spool and the take-up spool toward the supply spool saddle and the take-up spool saddle, respectively.

8. The drive train of claim 1, wherein at least one of the take-up drag-overrun assembly and the supply drag-overrun assembly further comprises:

a spindle;

a one-way clutch carried by the spindle;

a torsion spring frictionally fit to the one-way clutch; and a gear carried by the spindle and coupled to a leg of the torsion spring;

wherein rotating the gear by the drive motor in a first direction tends to wind the torsion spring and rotates the one-way clutch in a freewheel direction such that the gear, one-way clutch, and torsion spring rotate substantially in unison; and where rotating the gear by one of the supply spool and the take-up spool in a second direction tends to unwind the torsion spring and urge the one-way clutch in a locked direction such that the gear rotates relative to the one-way clutch and the torsion spring slips relative to the one-way clutch.

9. A drive train for a printer, comprising:

a drive motor for driving a drive roller about a drive axis and at least one of a supply spool and a take-up spool to wind and unwind a ribbon about the supply spool and the take-up spool depending upon a direction of rotation of the drive motor;

a drive direction assembly operationally coupled to the drive motor and pivotable about the drive axis between a downstream direction at which the drive motor drives the take-up spool to unwind the ribbon from the supply spool and wind the ribbon about the take-up spool and an upstream direction at which the drive motor drives the supply spool to unwind the ribbon from the take-up spool and wind the ribbon about the supply spool;

a take-up slip-overdrive assembly operationally engaged with the take-up spool and selectively engaged with the drive direction assembly when the drive direction assembly is in the downstream direction;

a supply drag-overrun assembly operationally engaged with the supply spool;

a supply slip-overdrive assembly operationally engaged with the supply spool and selectively engaged with the drive direction assembly when the drive direction assembly is in the upstream direction;

a take-up drag-overrun assembly operationally engaged with the take-up spool;

wherein the take-up slip-overdrive assembly maintains a take-up tension in the ribbon downstream of the drive roller by overdriving the take-up spool relative to the drive roller to wind the ribbon about the take-up spool;

wherein the supply drag-overrun assembly maintains a supply tension in the ribbon upstream of the drive roller by resisting unwinding of the ribbon from the supply spool;

wherein the supply slip-overdrive assembly maintains the supply tension in the ribbon downstream of the drive roller by overdriving the supply spool relative to the drive roller to wind the ribbon about the supply spool;

wherein the take-up drag-overrun assembly maintains the take-up tension in the ribbon upstream of the drive roller by resisting unwinding of the ribbon from the take-up spool; and wherein when the drive direction assembly pivots about the drive axis between the downstream direction and the upstream direction the drive direction assembly drives the drive roller before the take-up spool and the supply spool.

10. The drive train of claim 9, wherein the drive direction assembly further comprises:

a delay disk defining a delay disk face having at least one protrusion extending from the delay disk face, wherein the delay disk is coaxial with the drive axis and rotatably fixed to the drive roller;

an outer drive gear defining a first outer drive gear face and a second outer drive gear face adjacent the delay disk and including at least one slot sized to slideably receive the at least one protrusion extending from the delay disk face during relative rotation between the delay disk and the outer drive gear, wherein the outer drive gear is coaxial with the drive axis;

an inner drive gear defining a first inner drive gear face and a second inner drive gear face adjacent the first outer drive gear face, wherein the inner drive gear is coaxial with the drive axis;

a drive gear hub extending axially away from the first inner drive gear face, wherein the drive gear hub is coaxial with the drive axis;

a direction arm defining a direction arm hub rotatably engaged to the drive gear hub, wherein the direction arm hub is coaxial with the drive axis;

a downstream drive gear rotatably coupled to the direction arm and engaging the inner drive gear for selectively driving the take-up spool; and an upstream drive gear rotatably coupled to the direction arm and engaging the inner drive gear for selectively driving the supply spool;

wherein the direction arm rotates about the drive axis depending on the direction of rotation of the drive motor such that the downstream drive gear and the upstream drive gear rotate prior to the delay disk as the at least one protrusion slides along the at least one slot.

11. The drive train of claim 9, wherein at least one of the take-up slip-overdrive assembly and supply slip-overdrive assembly further comprises:

a first gear for engaging at least one of the supply spool and the take-up spool, and defining an inner bore;

a torsion spring having a leg and frictionally fit to the inner bore to supply an outward radial force against the inner bore; and a second gear adjacent the first gear rotationally coupled to the leg of the torsion spring;

wherein relative rotation of at least one of the first gear and second gear in a first direction tends to decrease the outward radial force supplied by the torsion spring; and wherein relative rotation of at least one of the first gear and second gear in a second direction opposite to the first direction tends to increase the outward radial force supplied by the torsion spring.

12. The drive train of claim 11, wherein the first gear directly engages an idler gear that is engaged with one of the supply spool and the take-up spool.

13. The drive train of claim 9, wherein at least one of the supply drag-overrun assembly and the take-up drag-overrun assembly further comprises:

a hub having an outer surface and an inner surface;

an outer torsion spring having an outer leg and frictionally fit to the outer surface to supply an inward radial force against the outer surface;

an inner torsion spring having an inner leg and frictionally fit to the inner surface to supply an outward radial force against the inner surface; and a gear rotationally coupled to the inner leg of the inner torsion spring;

wherein when the outer leg is fixed to a printer frame, rotation of the gear by one of the supply spool and the take-up spool in a first direction tends to decrease the outward radial force supplied by the inner torsion spring and tends to increase the inward radial force supplied by the outer torsion spring, and rotation of the gear by the drive motor in a second direction opposite to the first direction tends to increase the outward radial force supplied by the inner torsion spring and tends to decrease the inward radial force supplied by the outer torsion spring.

14. The drive train of claim 9, further comprising:

a frame defining a supply spool saddle for carrying the supply spool and a take-up spool saddle for carrying the take-up spool;

wherein an arrangement of at least one of the take-up slip-overdrive assembly and the supply drag-overrun assembly urges at least one of the supply spool and the take-up spool toward the supply spool saddle and the take-up spool saddle, respectively.

15. The drive train of claim 9, wherein at least one of the take-up drag-overrun assembly and the supply drag-overrun assembly further comprises:

a spindle;

a one-way clutch carried by the spindle;

a torsion spring frictionally fit to the one-way clutch; and a gear carried by the spindle and coupled to a leg of the torsion spring;

wherein rotating the gear by the drive motor in a first direction tends to wind the torsion spring and rotates the one-way clutch in a freewheel direction such that the gear, one-way clutch, and torsion spring rotate substantially in unison; and where rotating the gear by one of the supply spool and the take-up spool in a second direction tends to unwind the torsion spring and urge the one-way clutch in a locked direction such that the gear rotates relative to the one-way clutch and the torsion spring slips relative to the one-way clutch.

16. A drive train for a printer, comprising:

a drive motor for selectively driving a drive roller and a take-up spool to unwind a ribbon from a supply spool and wind the ribbon about the take-up spool;

a take-up slip-overdrive assembly operationally engaged with the drive motor and the take-up spool to maintain a take-up tension in the ribbon downstream of the drive roller by overdriving the take-up spool relative to the drive roller to wind the ribbon about the take-up spool;

a supply drag-overrun assembly operationally engaged with the supply spool to maintain a supply tension in the ribbon upstream of the drive roller by resisting unwinding of the ribbon from the supply spool; and a drive direction assembly operationally coupled to the drive motor and pivotable about the drive axis between a downstream direction at which the drive motor drives the take-up spool and an upstream direction at which the drive motor drives the supply spool, the drive direction assembly comprises:

a delay disk defining a delay disk face having at least one protrusion extending from the delay disk face, wherein the delay disk is coaxial with a drive axis of the drive roller and rotatably fixed to the drive roller;

an outer drive gear defining a first outer drive gear face and a second outer drive gear face adjacent the delay disk and including at least one slot sized to slidably receive the at least one protrusion extending from the delay disk face during relative rotation between the delay disk and the outer drive gear, wherein the outer drive gear is coaxial with the drive axis;

an inner drive gear defining a first inner drive gear face and a second inner drive gear face adjacent the first outer drive gear face, wherein the inner drive gear is coaxial with the drive axis;

a drive gear hub extending axially away from the first inner drive gear face, wherein the drive gear hub is coaxial with the drive axis;

a direction arm defining a direction arm hub rotatably engaged to the drive gear hub, wherein the direction arm hub is coaxial with the drive axis;

a downstream drive gear rotatably coupled to the direction arm and engaging the inner drive gear for selectively driving the take-up spool; and an upstream drive gear rotatably coupled to the direction arm and engaging the inner drive gear for selectively driving the supply spool;

wherein the direction arm rotates about the drive axis depending on the direction of rotation of the drive motor such that the downstream drive gear and the upstream drive gear rotate prior to the delay disk as the at least one protrusion slides along the at least one slot.

17. A drive train for a printer, comprising:

a drive motor for driving a drive roller about a drive axis and at least one of a supply spool and a take-up spool to wind and unwind a ribbon about the supply spool and the take-up spool depending upon a direction of rotation of the drive motor;

a drive direction assembly operationally coupled to the drive motor and pivotable about the drive axis between a downstream direction at which the drive motor drives the take-up spool to unwind the ribbon from the supply spool and wind the ribbon about the take-up spool and an upstream direction at which the drive motor drives the supply spool to unwind the ribbon from the take-up spool and wind the ribbon about the supply spool, the drive direction assembly comprises:

a delay disk defining a delay disk face having at least one protrusion extending from the delay disk face, wherein the delay disk is coaxial with the drive axis and rotatably fixed to the drive roller;

an outer drive gear defining a first outer drive gear face and a second outer drive gear face adjacent the delay disk and including at least one slot sized to slideably receive the at least one protrusion extending from the delay disk face during relative rotation between the delay disk and the outer drive gear, wherein the outer drive gear is coaxial with the drive axis;

an inner drive gear defining a first inner drive gear face and a second inner drive gear face adjacent the first outer drive gear face, wherein the inner drive gear is coaxial with the drive axis;

a drive gear hub extending axially away from the first inner drive gear face, wherein the drive gear hub is coaxial with the drive axis;

a direction arm defining a direction arm hub rotatably engaged to the drive gear hub, wherein the direction arm hub is coaxial with the drive axis;

a downstream drive gear rotatably coupled to the direction arm and engaging the inner drive gear for selectively driving the take-up spool; and an upstream drive gear rotatably coupled to the direction arm and engaging the inner drive gear for selectively driving the supply spool;

wherein the direction arm rotates about the drive axis depending on the direction of rotation of the drive motor such that the downstream drive gear and the upstream drive gear rotate prior to the delay disk as the at least one protrusion slides along the at least one slot;

a take-up slip-overdrive assembly operationally engaged with the take-up spool and selectively engaged with the drive direction assembly when the drive direction assembly is in the downstream direction, the take-up slip-overdrive assembly maintains a take-up tension in the ribbon downstream of the drive roller by overdriving the take-up spool relative to the drive roller to wind the ribbon about the take-up spool;

a supply drag-overrun assembly operationally engaged with the supply spool, the supply drag-overrun assembly maintains a supply tension in the ribbon upstream of the drive roller by resisting unwinding of the ribbon from the supply spool;

a supply slip-overdrive assembly operationally engaged with the supply spool and selectively engaged with the drive direction assembly when the drive direction assembly is in the upstream direction, the supply slip-overdrive assembly maintains the supply tension in the ribbon downstream of the drive roller by overdriving the supply spool relative to the drive roller to wind the ribbon about the supply spool; and a take-up drag-overrun assembly operationally engaged with the take-up spool, the take-up drag-overrun assembly maintains the take-up tension in the ribbon upstream of the drive roller by resisting unwinding of the ribbon from the take-up spool.

* * * * *